US012037809B2

(12) United States Patent
Coberley et al.

(10) Patent No.: US 12,037,809 B2
(45) Date of Patent: Jul. 16, 2024

(54) FRAME THAT INCLUDES INTERLOCKING WALLS AND ASSOCIATED KITS AND METHODS

(71) Applicants: Robert Charles Coberley, Temperance, MI (US); Robert Charles Coberley, Jr., Temperance, MI (US)

(72) Inventors: Robert Charles Coberley, Temperance, MI (US); Robert Charles Coberley, Jr., Temperance, MI (US)

( * ) Notice: Subject to any disclaimer, the term of this patent is extended or adjusted under 35 U.S.C. 154(b) by 0 days.

(21) Appl. No.: 18/195,495

(22) Filed: May 10, 2023

(65) Prior Publication Data

US 2024/0060323 A1 Feb. 22, 2024

Related U.S. Application Data

(60) Provisional application No. 63/399,252, filed on Aug. 19, 2022.

(51) Int. Cl.
*E04H 4/14* (2006.01)

(52) U.S. Cl.
CPC ..... *E04H 4/14* (2013.01)

(58) Field of Classification Search
CPC ..... E04H 4/14; E04H 4/0018; E04H 4/0031; E04H 4/0043; E04H 4/005; E04H 4/0056; B65D 11/18; B65D 11/1866; B65D 11/1873; E04B 2001/327; E04B 2001/3276; E04B 2001/3282
USPC ..... 4/504; 220/4.28, 4.31, 4.32; 52/169.7, 52/169.8, 245, 247, 265, 284
See application file for complete search history.

(56) References Cited

U.S. PATENT DOCUMENTS

| | | | | |
|---|---|---|---|---|
| 1,842,192 | A | 1/1932 | Patterson | |
| 3,675,253 | A * | 7/1972 | Danzker | E04H 4/0043 52/284 |
| 3,798,857 | A | 3/1974 | Barrera | |
| 3,952,338 | A | 4/1976 | Troxclair | |
| 3,974,605 | A | 8/1976 | Beatty et al. | |
| 3,991,530 | A * | 11/1976 | Scourtes | E04H 4/00 52/146 |

(Continued)

FOREIGN PATENT DOCUMENTS

| | | |
|---|---|---|
| CN | 209413367 U | 9/2019 |
| ES | 1295703 U | 12/2022 |

(Continued)

OTHER PUBLICATIONS

PCT International Search Report and Written Opinion, Application No. PCT/US2023/021635, dated Aug. 11, 2023.

*Primary Examiner* — David P Angwin
*Assistant Examiner* — William R Klotz
(74) *Attorney, Agent, or Firm* — MacMillan, Sobanski & Todd, LLC

(57) ABSTRACT

Frames that include interlocking walls, frame kits, and associated methods are described. An example of a frame kit includes a first wall and a second wall. The first wall has a first wall main body that defines a first wall main body first notch. The second wall is interlockable with the first wall and has a second wall main body that defines a second wall main body first notch. A portion of the first wall is disposable within the second wall main body first notch. A portion of the second wall is disposable within the first wall main body first notch.

20 Claims, 12 Drawing Sheets

(56) References Cited

U.S. PATENT DOCUMENTS

| | | | | |
|---|---|---|---|---|
| 4,020,509 | A * | 5/1977 | West | E04H 4/0043 4/506 |
| 4,090,266 | A | 5/1978 | Price | |
| 4,126,905 | A | 11/1978 | Russell et al. | |
| 4,171,058 | A * | 10/1979 | Collins | B65D 9/12 217/65 |
| 4,238,859 | A | 12/1980 | Badon, Jr. | |
| 4,240,165 | A | 12/1980 | Kyrias | |
| 4,843,658 | A | 7/1989 | Hodak | |
| 5,018,324 | A | 5/1991 | Lankheet | |
| 5,381,915 | A * | 1/1995 | Yardley | B65D 19/16 220/4.28 |
| 5,400,555 | A | 3/1995 | Kantor | |
| 5,720,056 | A | 2/1998 | Aymes | |
| 5,727,264 | A | 3/1998 | Craig et al. | |
| 5,953,767 | A | 9/1999 | Cloffey | |
| D417,286 | S | 11/1999 | Sullivan | |
| 6,076,690 | A * | 6/2000 | Hemmerly | B65D 19/16 217/65 |
| 6,174,116 | B1 | 1/2001 | Brand | |
| 6,647,562 | B1 | 11/2003 | Arout et al. | |
| 7,412,802 | B2 | 8/2008 | Kantor | |
| 7,721,360 | B2 | 5/2010 | Bernardi et al. | |
| 11,098,496 | B2 * | 8/2021 | Kwiatkowski | E04H 4/005 |
| D958,406 | S | 7/2022 | Pain | |
| 2005/0198728 | A1 | 9/2005 | Valiquette | |
| 2005/0198731 | A1 | 9/2005 | Turpen | |
| 2006/0117475 | A1 | 6/2006 | Hsu | |
| 2006/0277851 | A1 | 12/2006 | Hudon et al. | |
| 2007/0039091 | A1 | 2/2007 | Foy | |
| 2007/0266651 | A1 | 11/2007 | Harig et al. | |
| 2008/0090668 | A1 * | 4/2008 | Freres | A63H 33/32 472/126 |
| 2009/0255051 | A1 | 10/2009 | Turpen | |
| 2010/0170174 | A1 * | 7/2010 | Wangdak | A47B 96/20 52/270 |
| 2012/0304373 | A1 | 12/2012 | Foster et al. | |
| 2021/0372151 | A1 * | 12/2021 | Herring | E04H 4/0018 |

FOREIGN PATENT DOCUMENTS

| | | | |
|---|---|---|---|
| GB | 2200840 | A | 8/1988 |
| WO | 2007004022 | A3 | 1/2007 |

* cited by examiner

FRAME THAT INCLUDES INTERLOCKING WALLS AND ASSOCIATED KITS AND METHODS

FIELD

The disclosure relates generally to the field of frames. More particularly, the disclosure relates to frames, such as in-ground pool frames, that include interlocking walls, frame kits that include interlocking walls, methods of manufacturing a frame that includes interlocking walls, methods of assembling a frame that includes interlocking walls, and methods of shipping a frame that includes interlocking walls.

BACKGROUND

Modular wall structures for underground pools have been developed that include distinct wall panels that are linked at their terminal edges to form a wall of a swimming pool. Generally, these panels utilize ground-resting transverse support braces that reinforce the panels and support a horizontal deck that will eventually rest on top of the panels and extend radially outward providing a deck surface for users of the pool.

However, current panels included in these modular wall structures have drawbacks. For example, some incorporate complex linkages between two adjacent panels that can be difficult and expensive to manufacture. Furthermore, these linkages can be time consuming and challenging to accomplish during installation. In addition, conventional panels require significant clearance to be dug around the perimeter of the swimming pool being installed to accommodate transverse braces, which can result in a walking deck being installed on soil that is not properly compacted. The production and installation costs associated with these panels is consequently relatively high.

A need exists, therefore, for new and useful frames that include interlocking walls, frame kits that include interlocking walls, methods of manufacturing a frame that includes interlocking walls, methods of assembling a frame that includes interlocking walls, and methods of shipping a frame that includes interlocking walls.

SUMMARY OF SELECTED EXAMPLE EMBODIMENTS

Various frames that include interlocking walls, frame kits that include interlocking walls, methods of manufacturing a frame that includes interlocking walls, methods of assembling a frame that includes interlocking walls, and methods of shipping a frame that includes interlocking walls are described herein.

An example embodiment of a frame kit includes a first base, a first wall, and a second wall. The first base has a first base top, a first base bottom, a first base interior end, a first base exterior end, a first base first opening, and a first base second opening. Each of the first base first opening and the first base second opening is disposed on the first base top between the first base interior end and the first base exterior end. The first wall is interlockable with the first base. The first wall has a first wall main body, a first wall first projection, and a first wall second projection. The first wall main body defines a first wall main body first notch and has a first wall interior surface. Each of the first wall first projection and the first wall second projection extends from the first wall main body and away from the first wall interior surface. The second wall is interlockable with the first wall and has a second wall main body that defines a second wall main body first notch. A portion of the first wall is disposable within the second wall main body first notch. A portion of the second wall is disposable within the first wall main body first notch. The first wall first projection is disposable within the base first opening. The first wall second projection is disposable within the base second opening.

Additional understanding of the exemplary frames, kits, and methods can be obtained by review of the detailed description, below, and the appended drawings.

DETAILED DESCRIPTION

Figure 1:
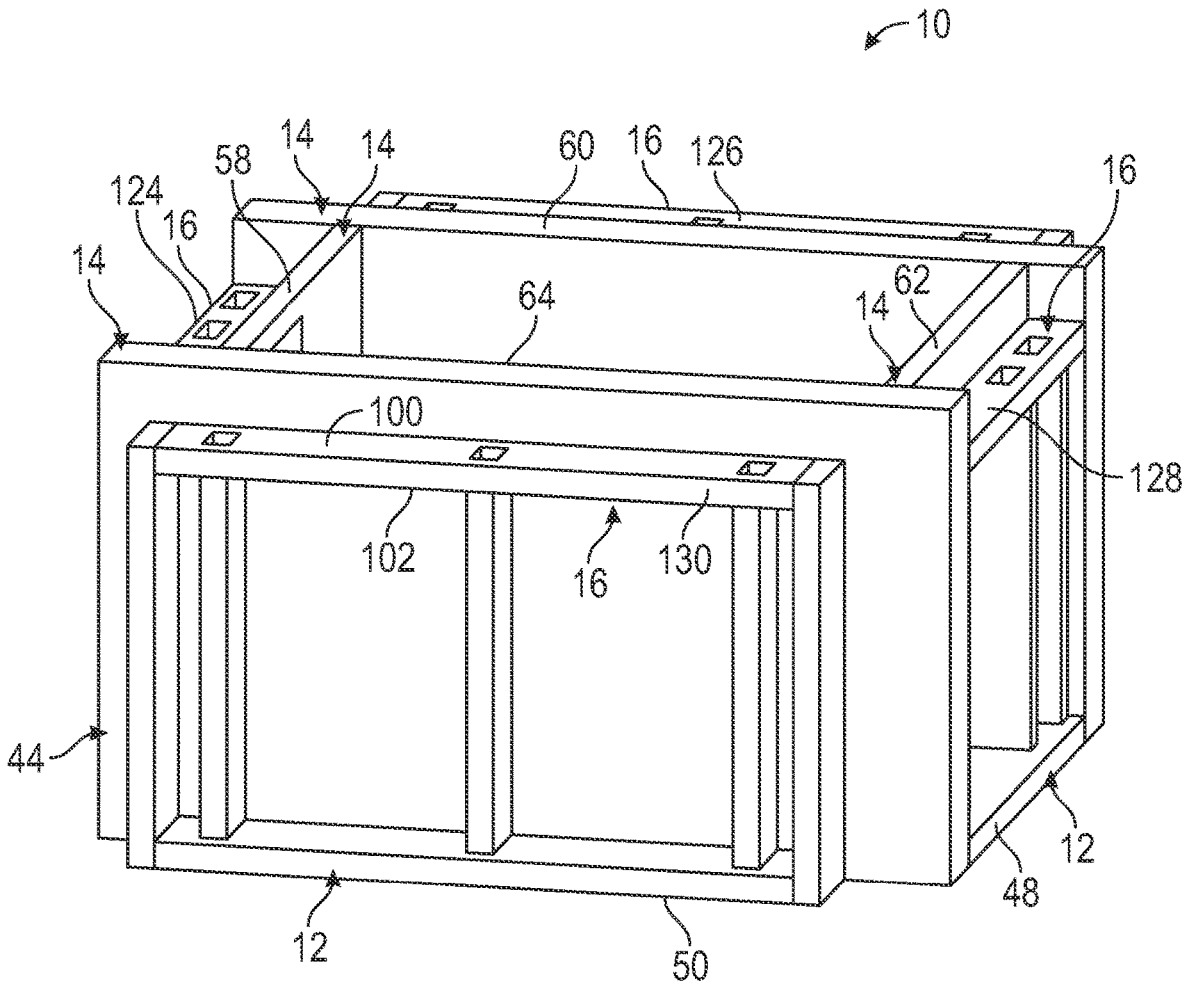
FIG. 1 is a perspective view of an example assembled frame that includes interlocking walls.

The following detailed description and the appended drawings describe and illustrate various example embodiments of frames that include interlocking walls, frame kits that include interlocking walls, methods of manufacturing a frame that includes interlocking walls, methods of assembling a frame that includes interlocking walls, and methods of shipping a frame that includes interlocking walls. The description and illustration of these examples are provided to enable one skilled in the art to make and use a frame that includes interlocking walls, a frame kit that includes interlocking walls, practice a method of manufacturing a frame that includes interlocking walls, practice a method of assembling a frame that includes interlocking walls, and practice a method of shipping a frame that includes interlocking walls. They are not intended to limit the scope of the claims in any manner. The invention is capable of being practiced or carried out in various ways and the examples described and illustrated herein are merely selected examples of the various ways of practicing or carrying out the invention and are not considered exhaustive.

FIGS. 1 through 9 illustrate an example frame 10 that includes interlocking walls 14. The frame 10 can be used to form any suitable structure and selection of a suitable structure to form using an illustrated embodiment can be based on various considerations, such as the intended function the frame being constructed. Examples of structures considered suitable to form using a frame described herein include in-ground pool frames, above-ground pool frames, frames for retaining walls, wall structures, shelters, such as tornado shelters, and any other structure considered suitable for a particular embodiment.

In the illustrated embodiment, the frame 10 has a plurality of bases 12, a plurality of interlocking walls 14, and a plurality of caps 16.

Figure 2:
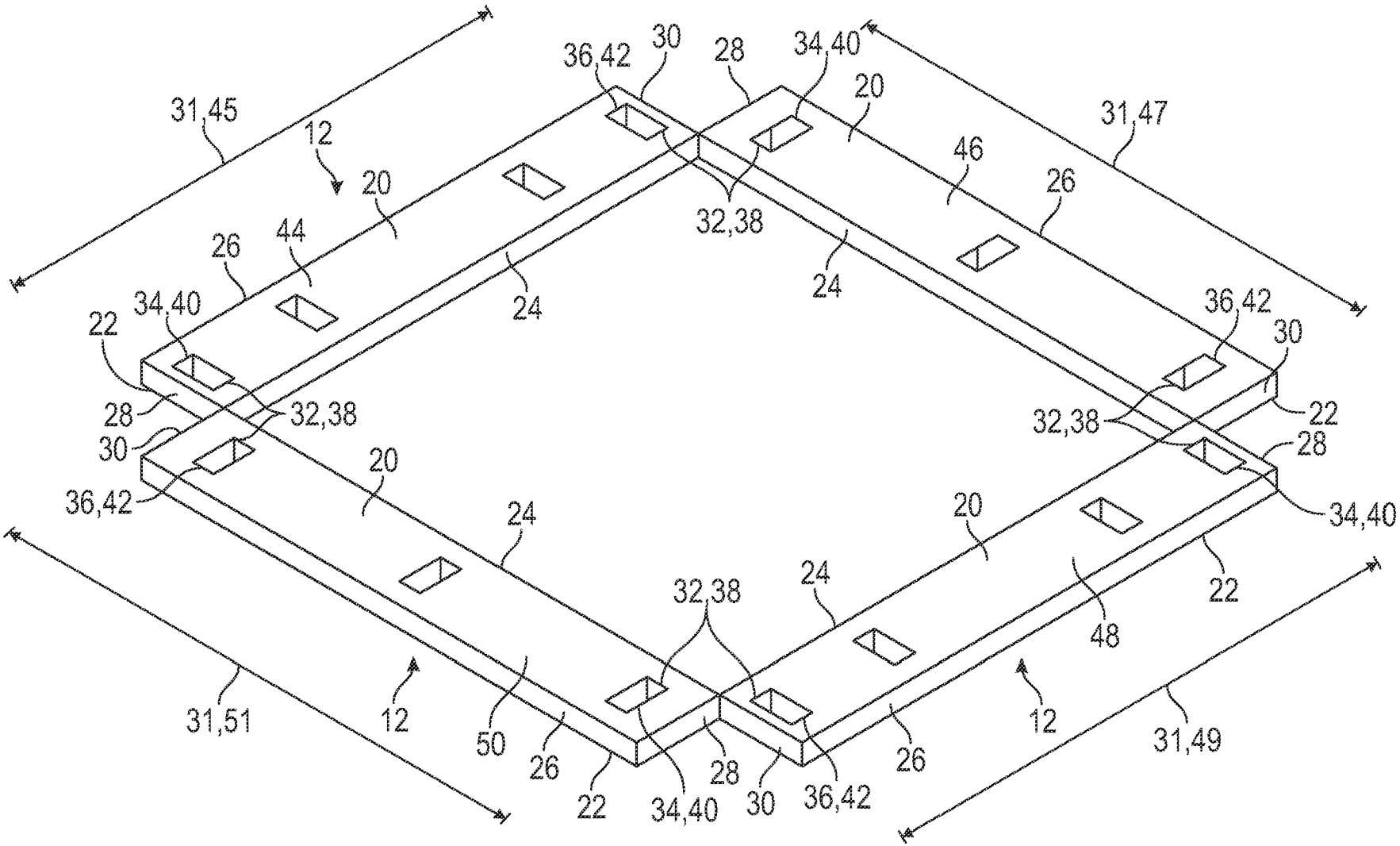
FIG. 2 is a perspective view of the first base, the second base, the third base, and the fourth base of the frame shown in FIG. 1.

Each base of the plurality of bases 12 has a base top 20, a base bottom 22, a base interior end 24, a base exterior end 26, a base first terminal end 28, a base second terminal end 30, a base length 31, and a plurality of base openings 32. The base length 31 extends from the base first terminal end 28 to the base second terminal end 30. Each base opening of the plurality of base openings 32 is disposed on the base top 20 between the base interior end 24 and the base exterior end 26 and between the base first terminal end 28 and the base second terminal end 30. As shown in FIG. 2, the plurality of base openings 32 includes a base first opening 34 and a base second opening 36. Each of the base first opening 34 and the base second opening 36 is disposed on the base top 20 between the base interior end 24 and the base exterior end 26.

An opening included on a base can provide access to any suitable void defined by a base and selection of a suitable void to which an opening provides access can be based on various considerations, such as the intended use of a frame of which a base is a component. Examples of suitable voids to which an opening provides access include recesses, passageways, and any other void considered suitable for a particular embodiment. In the illustrated embodiment, each base of the plurality of bases 12 has a plurality of base passageways 38. Each passageway of the plurality of base passageways 38 extends from a discrete opening of the plurality of base openings 32 to the base bottom 22. As shown in FIG. 2, the plurality of base passageways 38 includes a base first passageway 40 and a base second passageway 42. The base first passageway 40 extends from the base first opening 34 to the base bottom 22 and is disposed between the base interior end 24 and the base exterior end 26. The base second passageway 42 extends from the base second opening 36 to the base bottom 22 and is disposed between the base interior end 24 and the base exterior end 26.

While the frame 10 has been illustrated as including a plurality of bases 12, any suitable number of bases can be included in a frame. Selection of a suitable number of bases to include in a frame can be based on various considerations, including the intended use of a frame. Examples of numbers of bases considered suitable to include in a frame include one, more than one, two, a plurality, three, four, five, six, more than six, and any other number considered suitable for a particular embodiment. In the illustrated embodiment, the frame 10 includes a first base 44, a second base 46, a third base 48, and a fourth base 50.

The first base 44 has a first length 45, the second base 46 has a second length 47, the third base 48 has a third length 49, and the fourth base 50 has a fourth length 51. In the illustrated embodiment, the first and third lengths 45, 49 are the same and the second and fourth lengths 47, 51 are the same and the same as the first and third lengths 45, 49. However, alternative embodiments can include a base having any suitable length relative to another base, such as equal to, less than, or greater than the length of another base. For example, a base included in a frame can have any suitable length, such as a length that is greater than one, or more than one, walls. The first base 44 and the third base 48 include four openings in the plurality of base openings 32 and four passageways in the plurality of passageways 38. The second base 46 and the fourth base 50 include three openings in the plurality of base openings 32 and three passageways in the plurality of passageways 38.

While each base of the plurality of bases 12 has been illustrated as including a plurality of base openings 32 and a plurality of base passageways 38, any suitable number of openings, passageways, and/or recesses can be included in a base. Selection of a suitable number of openings, passageways, and/or recesses to include in a base can be based on various considerations, including the intended use of a frame and/or the number of projections included on a wall, as described herein. Examples of numbers of openings, passageways, and/or recesses considered suitable to include in a base include one, more than one, two, a plurality, three, four, five, six, more than six, and any other number considered suitable for a particular embodiment.

Each wall of the plurality of interlocking walls 14 has a wall main body 54 and a plurality of projections 56. In the embodiment shown, the plurality of interlocking walls 14 includes a first wall 58, a second wall 60, a third wall 62, and a fourth wall 64. When disassembled, as shown in FIGS. 4 through 9, each wall of the plurality of interlocking walls 14 is interlockable with a base of the plurality of bases 12 and a cap of the plurality of caps 16. When disassembled, the first wall 58 is interlockable with the first base 44, the second wall 60 is interlockable with the second base 46, the third wall 62 is interlockable with the third base 48, and a fourth wall 64 is interlockable with the fourth base 50. When assembled, as shown in FIG. 1, each wall of the plurality of interlocking walls 14 is interlocked with a base of the plurality of bases 12. When assembled, the first wall 58 is interlocked with the first base 44, the second wall 60 is interlocked with the second base 46, the third wall 62 is interlocked with the third base 48, and a fourth wall 64 is interlocked with the fourth base 50.

The wall main body 54 of each wall of the plurality of interlocking walls 14 has a wall top 66, a wall bottom 68, wall interior surface 70, a wall exterior surface 72, a wall first terminal end 74, a wall second terminal end 76, a wall length 77, and one or more wall main body notches 78. The wall length 77 extends from the wall first terminal end 74 to the wall second terminal end 76. The wall length 77 of the first wall 58 is greater than the first base length 45. The wall length 77 of the second wall 60 is greater than the second base length 47. The wall length 77 of the third wall 62 is greater than the third base length 49. The wall length 77 of the fourth wall 64 is greater than the fourth base length 51. However, alternative embodiments can include a wall that has a length that is greater than, less than, or equal to a base length. The length of a wall can be any suitable length and based upon the type of frame intended to be installed. Examples of lengths considered suitable for a wall length include lengths equal to, greater than, or less than 4 feet, 8 feet, lengths less than 4 feet, lengths greater than 4 feet, lengths less than 8 feet, lengths greater than 8 feet, and any other length considered suitable for a particular embodiment.

In the illustrated embodiment, the one or more wall main body notches 78 includes a wall main body first notch 80 and a wall main body second notch 82. In the illustrated embodiment, each of the wall main body first notch 80 and the wall main body second notch 82 extends from the wall interior surface 70 to the wall exterior surface 72. Each of the wall main body first notch 80 and the wall main body second notch 82 included on the first wall 58 and the third wall 62 extends from the wall top 66 toward the wall bottom 68 and each of the wall main body first notch 80 and the wall main body second notch 82 included on the second wall 60 and the fourth wall 64 extends from the wall bottom 68 toward the wall top 66. However, alternative embodiments can include any suitable configuration of wall main body notches, oriented in any manner described herein, such as an opposite configuration in which a wall main body first notch and a wall main body second notch included on a first wall and a third wall extends from a wall bottom toward a wall top and each of a wall main body first notch and a wall main body second notch included on a second wall and a fourth wall extends from the wall top toward the wall bottom. Alternatively, a wall can omit one, or both, wall main body notches and include the other structure described herein as being included on a wall. For example, a frame can include eight, or more, total walls. Four total bases, four total caps, and four total walls can be included as a frame. A wall of the plurality of walls can be disposed between two other walls coaxially. The wall can omit both wall main body notches and be attached to the adjacent walls using a base and a cap.

When assembled, as shown in FIG. 1, a portion of the second wall 60 is disposed within the wall main body second notch 82 of the first wall 58 and within the wall main body first notch 80 of the third wall 62 and a portion of the fourth wall 64 is disposed within the wall main body first notch 80 of the first wall 58 and within the wall main body second notch 82 of the third wall 62. When disassembled, as shown in FIGS. 4 through 9, a portion of the second wall 60 is disposable within the wall main body second notch 82 of the first wall 58 and within the wall main body first notch 80 of the third wall 62 and a portion of the fourth wall 64 is disposable within the wall main body first notch 80 of the first wall 58 and within the wall main body second notch 82 of the third wall 62.

Each projection of the plurality of projections 56 extends from the wall main body 54 and away from the wall interior surface 70. When assembled, each projection of the plurality of projections 56 is partially disposed within a base of the plurality of bases 12 and a cap of the plurality of caps 16. When disassembled, each projection of the plurality of projections 56 is disposable within a base of the plurality of bases 12 and a cap of the plurality of caps 16. In the illustrated embodiment, each projection of the plurality of wall projections 56 extends from the wall exterior surface 72 and away from the wall interior surface 70. Each projection of the plurality of projections 56 cooperatively defines a wall bottom notch 84 and a wall top notch 86 with the wall main body 54. As shown in FIGS. 4 through 9, the plurality of wall projections 56 includes a wall first projection 88 and a wall second projection 90. The wall first projection 88 has a wall bottom notch 84 and a wall top notch 86 and the wall second projection 90 has a wall bottom notch 84 and a wall top notch 86. In the illustrated embodiment, the depth of a wall bottom notch 84 is equal to the thickness of a base of the plurality of bases 12 and the depth of a wall top notch 86 is equal to the thickness of a cap of the plurality of caps 16. However, alternative embodiments can include a notch that has a depth greater than, or less than, the thickness of a base or a cap.

When assembled, a portion of the first wall 58 is disposed within the first base 44, a portion of the second wall 60 is disposed within the second base 46, a portion of the third wall 62 is disposed within the third base 48, and a portion of the fourth wall 64 is disposed within the fourth base 50. The wall first projection 88 of each wall of the plurality of walls 14 is disposed within the base first opening 34 and the base first passageway 40. The wall second projection 90 of each wall of the plurality of walls 14 is disposed within the base second opening 36 and the base second passageway 42.

When disassembled, a portion of the first wall 58 is disposable within the first base 44, a portion of the second wall 60 is disposable within the second base 46, a portion of the third wall 62 is disposable within the third base 48, and a portion of the fourth wall 64 is disposable within the fourth base 50. The wall first projection 88 of each wall of the plurality of walls 14 is disposable within the base first opening 34 and the base first passageway 40. The wall second projection 90 of each wall of the plurality of walls 14 is disposable within the base second opening 36 and the base second passageway 42.

While a first wall 58, a second wall 60, a third wall 62, and a fourth wall 64 have been illustrated as being included in the plurality of walls 14, any suitable number of walls can be included in a plurality of walls included in a frame. Selection of a suitable number of walls to include in a frame can be based on various considerations, including the intended use of a frame. Examples of numbers of walls considered suitable to include in a frame include one, more than one, two, a plurality, three, four, five, six, more than six, and any other number considered suitable for a particular embodiment.

While each wall of the plurality of walls 14 has been illustrated as including a plurality of projections 56 and one or more wall main body notches 78, any suitable number of projections and/or wall main body notches can be included in a wall. Selection of a suitable number of projections and/or wall main body notches to include in a wall can be based on various considerations, including the intended use of a frame. Examples of numbers of projections and/or wall main body notches considered suitable to include in a wall include one, more than one, two, a plurality, three, four, five, six, more than six, and any other number considered suitable for a particular embodiment.

Figure 4:
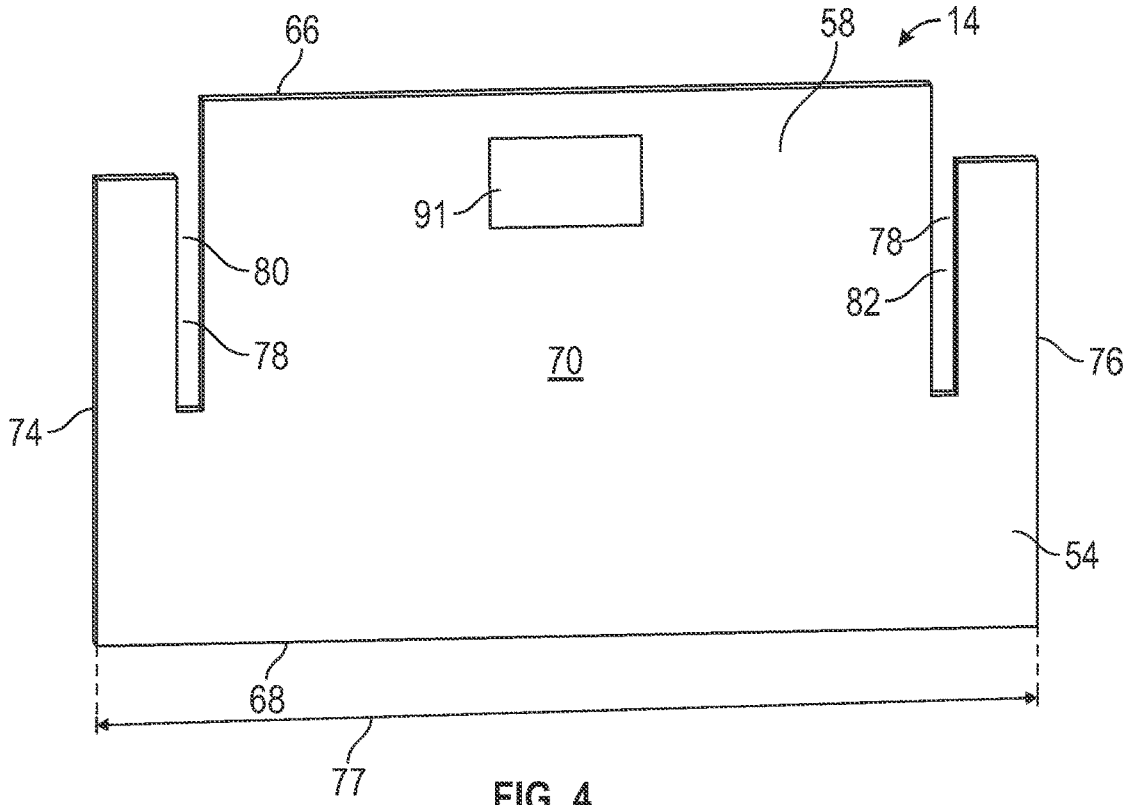
FIG. 4 is a perspective view of the first wall of the frame shown in FIG. 1.
Figure 5:
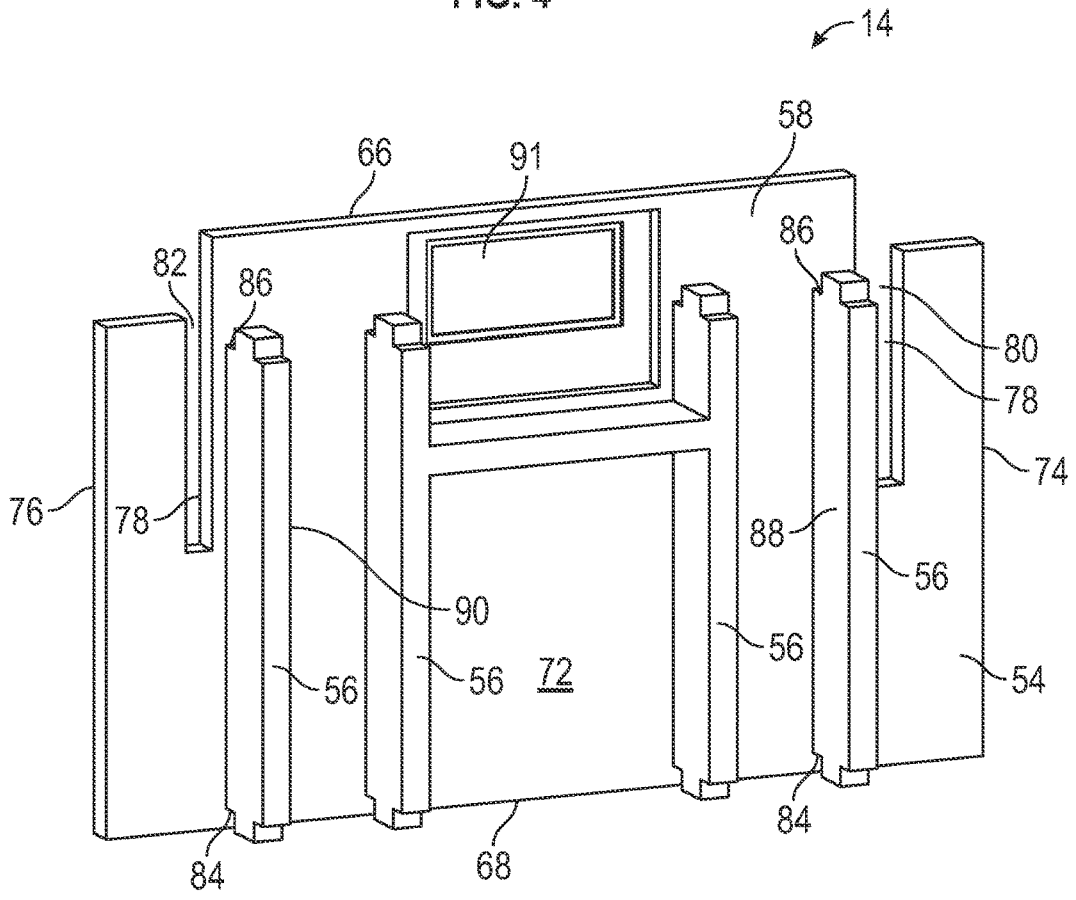
FIG. 5 is another perspective view of the first wall shown in FIG. 4.
Figure 6:
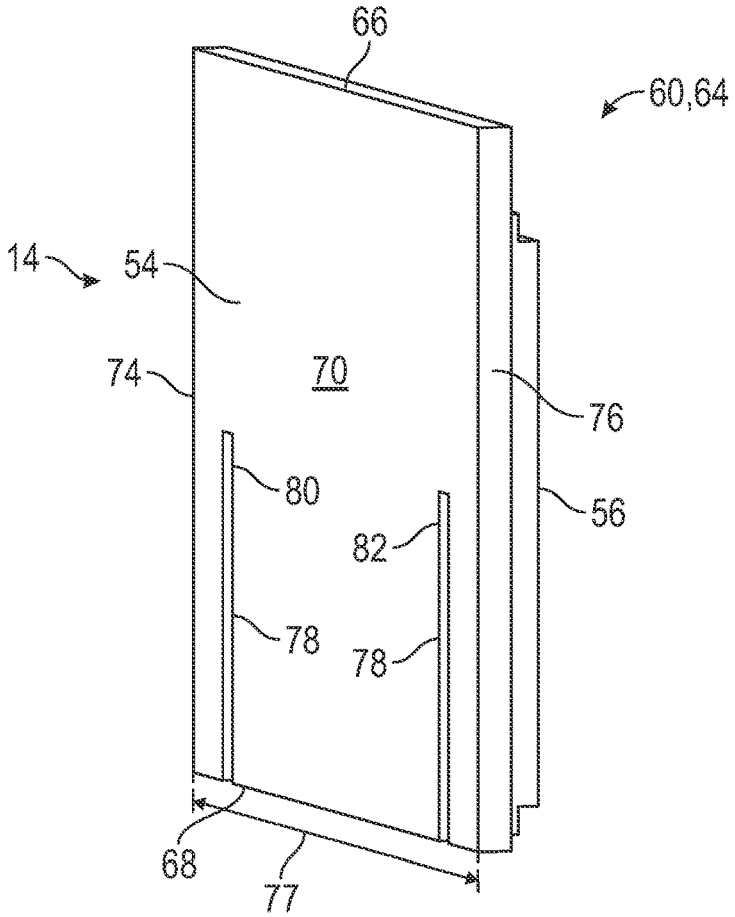
FIG. 6 is a perspective view of the second wall and the fourth wall of the frame shown in FIG. 1.
Figure 7:
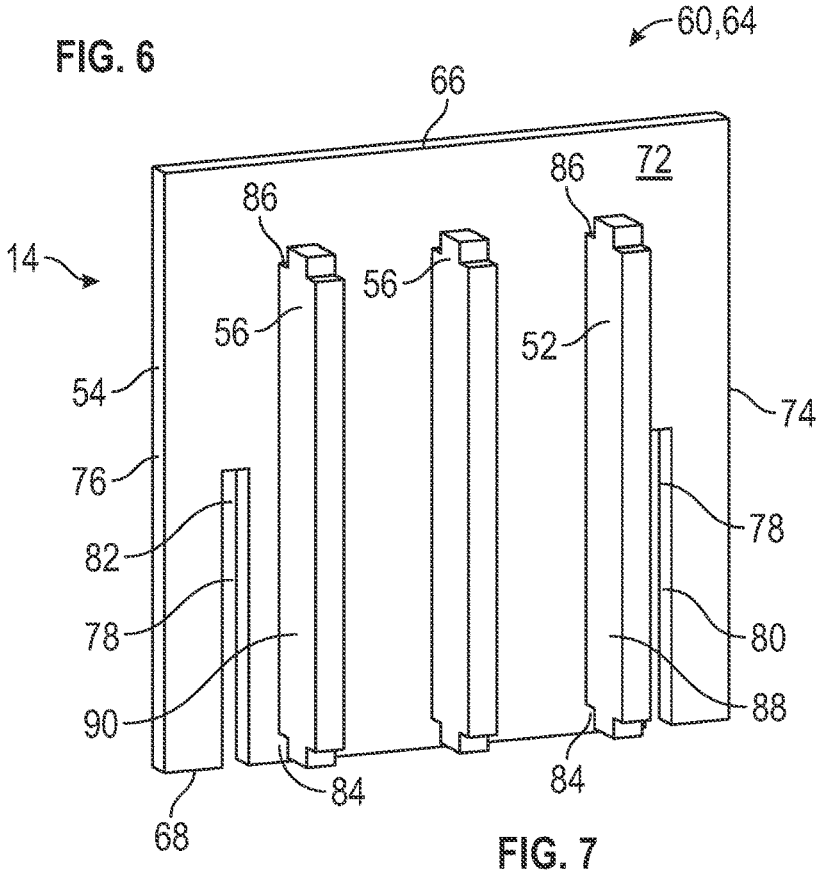
FIG. 7 is another perspective view of the second wall and the fourth wall shown in FIG. 6.
Figure 8:
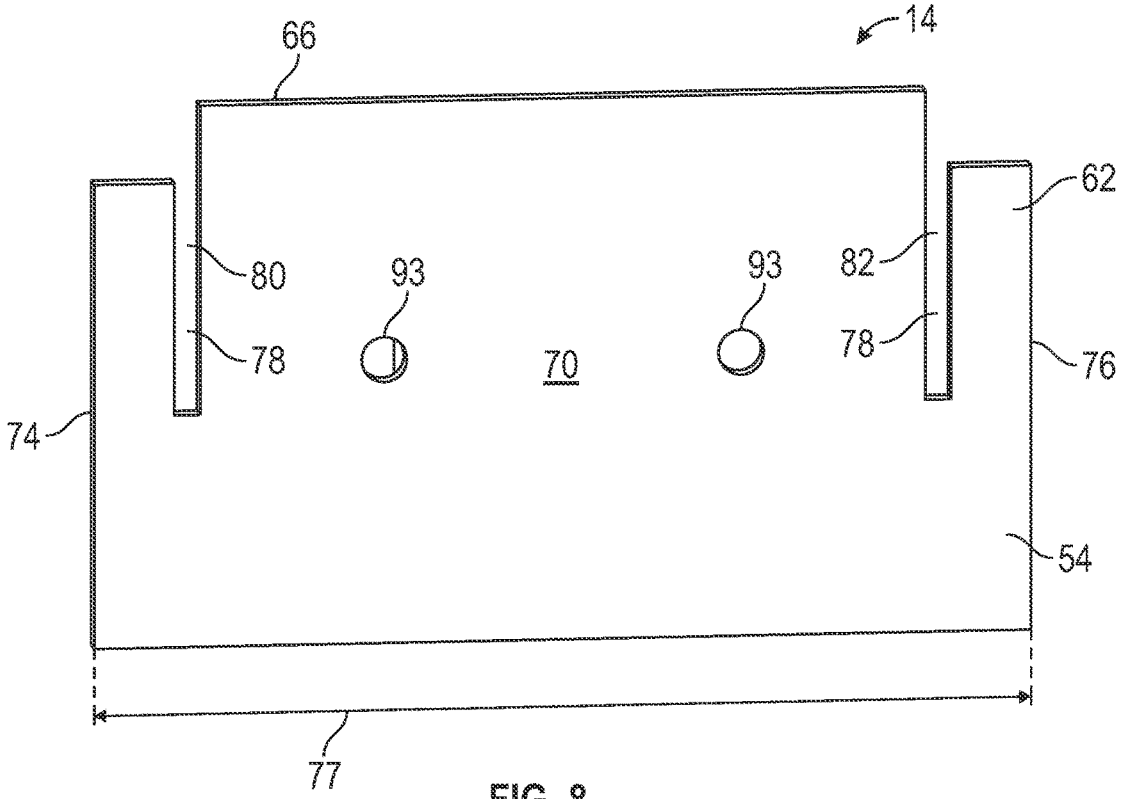
FIG. 8 is a perspective view of the third wall of the frame shown in FIG. 1.
Figure 9:
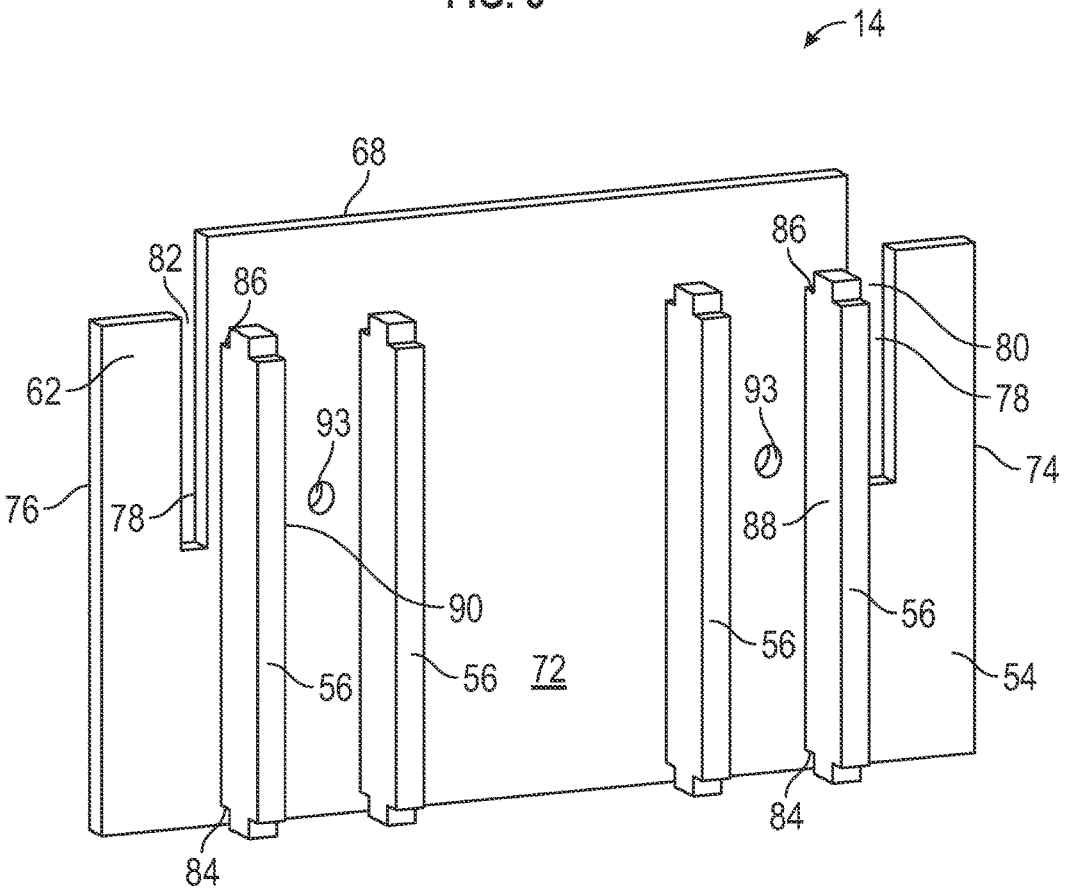
FIG. 9 is another perspective view of the third wall shown in FIG. 8.

A wall included in a frame can include additional structural features depending on the intended use of the wall. For example, as shown in FIGS. 4 and 5, when a frame is being used as a pool frame, a wall can include an opening 91 for a pool filter and, as shown in FIGS. 8 and 9, can include openings for other plumbing components. Any suitable structural features can be included in a wall and selection of particular features to include on a wall can be based on various considerations, such as the intended use of a frame of which the wall is a component.

Figure 3:
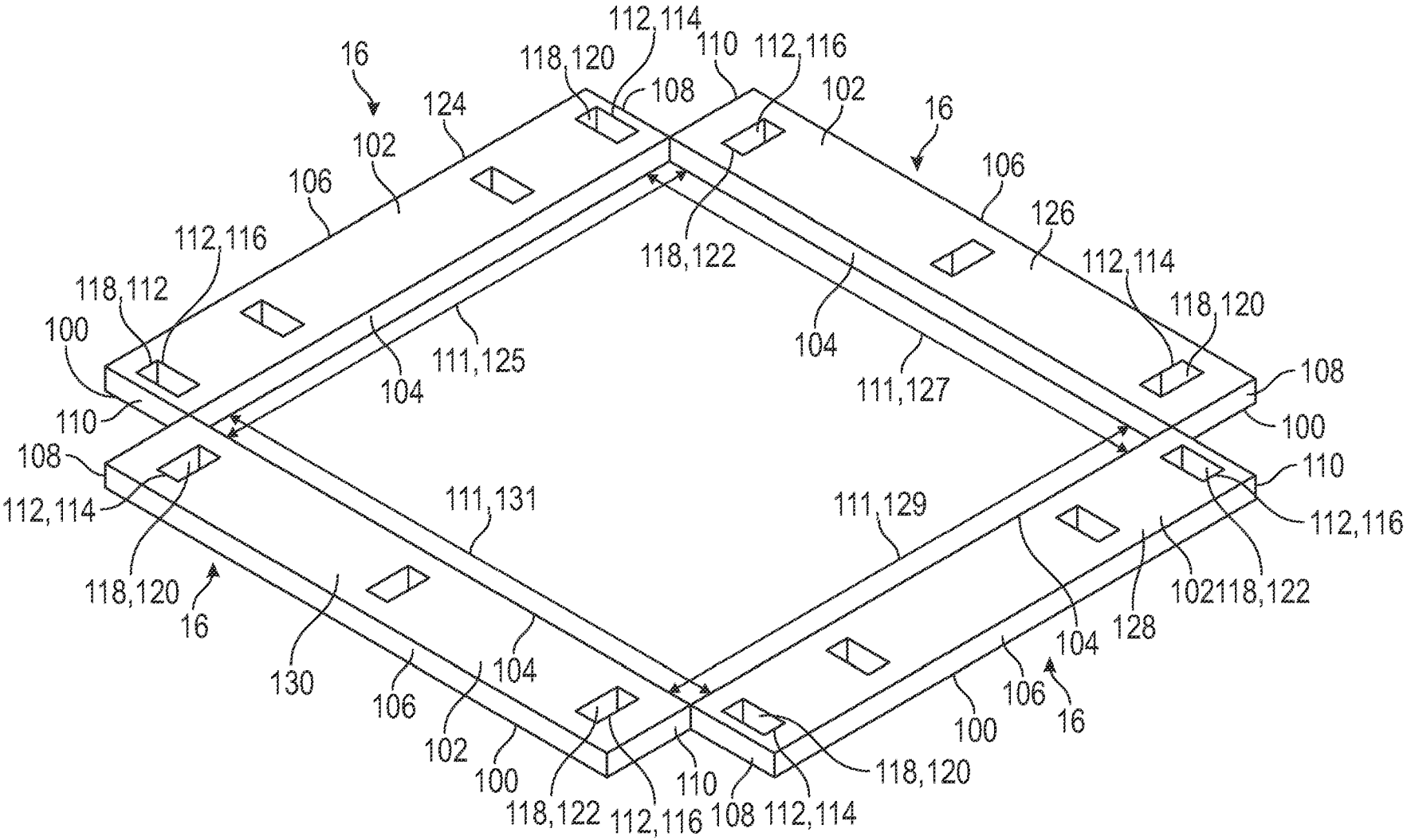
FIG. 3 is a perspective view of the first cap, the second cap, the third cap, and the fourth cap of the frame shown in FIG. 1.

Each cap of the plurality of caps 16 has a cap top 100, a cap bottom 102, a cap interior end 104, a cap exterior end 106, a cap first terminal end 108, a cap second terminal end 110, a cap length 111, and a plurality of cap openings 112. The cap length 111 extends from the cap first terminal end 108 to the cap second terminal end 110 and is less than the wall length 77. However, alternative embodiments can include a cap that has a cap length that is equal to, or greater than, a wall length. Each cap opening of the plurality of cap openings 112 is disposed on the cap bottom 102 between the cap interior end 104 and the cap exterior end 106 and between the cap first terminal end 108 and the cap second terminal end 110. As shown in FIG. 3, the plurality of cap openings 112 includes a cap first opening 114 and a cap second opening 116. Each of the cap first opening 114 and the cap second opening 116 is disposed on the cap bottom 102 between the cap interior end 104 and the cap exterior end 106.

An opening included on a cap can provide access to any suitable void defined by a cap and selection of a suitable void to which an opening provides access can be based on various considerations, such as the intended use of a frame of which a cap is a component. Examples of suitable voids to which an opening provides access include recesses, passageways, and any other void considered suitable for a particular embodiment. In the illustrated embodiment, each cap of the plurality of caps 16 has a plurality of cap passageways 118. Each passageway of the plurality of base passageways 118 extends from a discrete opening of the plurality of cap openings 112 to the cap top 100. As shown in FIG. 3, the plurality of cap passageways 118 includes a cap first passageway 120 and a cap second passageway 122. The cap first passageway 120 extends from the cap first opening 114 to the cap top 100 and disposed between the cap interior end 104 and the cap exterior end 106. The cap second passageway 122 extends from the cap second opening 116 to the cap top 100 and is disposed between the cap interior end 104 and the cap exterior end 106.

While the frame 10 has been illustrated as including a plurality of caps 16, any suitable number of caps can be included in a frame. Selection of a suitable number of caps to include in a frame can be based on various considerations, including the intended use of a frame. Examples of numbers of caps considered suitable to include in a frame include one, more than one, two, a plurality, three, four, five, six, more than six, and any other number considered suitable for a particular embodiment. In the illustrated embodiment, the frame 10 includes a first cap 124, a second cap 126, a third cap 128, and a fourth cap 130.

The first cap 124 has a first length 125, the second cap 126 has a second length 127, the third cap 128 has a third length 129, and the fourth cap 130 has a fourth length 131. In the illustrated embodiment, the first and third lengths 125, 129 are the same and less than the wall lengths 77 of the first and third walls 58, 62 and the second and fourth lengths 127, 131 are the same, equal to the first and third lengths 125, 129, and less than the wall lengths 77 of the second and fourth walls 60, 64. However, alternative embodiments can include a cap having any suitable length relative to another cap and/or wall, such as equal to, less than, or greater than the length of another cap and/or wall. For example, a cap included in a frame can have any suitable length, such as a length that is greater than one wall or more than one wall. The first cap 124 and the third cap 128 include four openings in the plurality of cap openings 112 and four passageways in the plurality of cap passageways 118. The second cap 126 and the fourth cap 130 include three openings in the plurality of cap openings 112 and three passageways in the plurality of cap passageways 118.

While each cap of the plurality of caps 16 has been illustrated as including a plurality of caps openings 112 and a plurality of caps passageways 118, any suitable number of openings, passageways, and/or recesses can be included in a cap. Selection of a suitable number of openings, passageways, and/or recesses to include in a cap can be based on various considerations, including the intended use of a frame. Examples of numbers of openings, passageways, and/or recesses considered suitable to include in a cap include one, more than one, two, a plurality, three, four, five, six, more than six, and any other number considered suitable for a particular embodiment.

When assembled, as shown in FIG. 1, each cap of the plurality of caps 16 is interlocked with a wall of the plurality of walls 14. When assembled, as shown in FIG. 1, the first cap 124 is interlocked with the first wall 58, the second cap 126 is interlocked with the second wall 60, the third cap 128 is interlocked with the third wall 62, and a fourth cap 130 is interlocked with the fourth wall 64. When disassembled, as shown in FIG. 3, each cap of the plurality of caps 16 is interlockable with a wall of the plurality of walls 14. When disassembled, as shown in FIG. 3, the first cap 124 is interlockable with the first wall 58, the second cap 126 is interlockable with the second wall 60, the third cap 128 is interlockable with the third wall 62, and a fourth cap 130 is interlockable with the fourth wall 64.

When assembled, as shown in FIG. 1, a portion of the first wall 58 is disposed within the first cap 124, a portion of the second wall 60 is disposed within the second cap 126, a portion of the third wall 62 is disposed within the third cap 128, and a portion of the fourth wall 64 is disposed within the fourth cap 130. When assembled, a portion of each wall of the plurality of walls 14 is disposed within each of the cap first opening 114 and the cap second opening 116. When assembled, the wall first projection 88 of each wall of the plurality of walls 14 is disposed within the cap first opening 114 and the cap first passageway 120 and the wall second projection 90 of each wall of the plurality of walls 14 is disposed within the cap second opening 116 and the cap second passageway 122.

When disassembled, as shown in FIG. 3, a portion of the first wall 58 is disposable within the first cap 124, a portion of the second wall 60 is disposable within the second cap 126, a portion of the third wall 62 is disposable within the third cap 128, and a portion of the fourth wall 64 is disposable within the fourth cap 130. When disassembled, a portion of each wall of the plurality of walls 14 is disposable within each of the cap first opening 114 and the cap second opening 116. When disassembled, the wall first projection 88 of each wall of the plurality of walls 14 is disposable within the cap first opening 114 and the cap first passageway 120 and the wall second projection 90 of each wall of the plurality of walls 14 is disposable within the cap second opening 116 and the cap second passageway 122.

A frame, and the portions of a frame (e.g., base, wall, cap) can be formed of any suitable material and selection of a suitable material can be based on various considerations, such as the intended use of a frame. Examples of materials considered suitable to form a frame, and portions of a frame (e.g., base, wall, cap), include composite materials, plastics, polymers, such as polypropylene, metals, alloys, materials that can be machined, cast, or 3D printed, and any other material considered suitable for a particular embodiment. Each portion of a frame (e.g., base, wall, cap) can be formed as a single integral piece of material, or include one or more pieces of material attached to one another, as described herein.

Optionally, a disassembled frame, such as the embodiments described herein (e.g., frame 10 and frame 210), can be provided as a frame kit that includes interlocking walls. A frame kit can include any suitable number and type of bases, walls, and/or caps, such as those described herein. A kit can be packages as a single unit, or packaged in multiple units, and provided to an assembler (e.g., shipped) for assembly.

When assembled, walls interlocked with one another can be disposed at any suitable angle relative to one another and selection of a suitable angle can be based on various considerations, such as the type of frame being assembled. Examples of angles considered suitable between interlocked walls (e.g., a first wall and a second wall) include angles equal to, greater than, or less than 45 degrees, 90 degrees, 135 degrees, and any other angle considered suitable for a particular embodiment.

FIGS. 10 through 19 illustrate another example frame 210 that includes interlocking walls 214. The frame 210 is similar to the frame 10 illustrated in FIGS. 1 through 9 and described above, except as detailed below. The frame 210 has a plurality of bases 212, a plurality of interlocking walls 214, and a plurality of caps 216.

Figure 11:
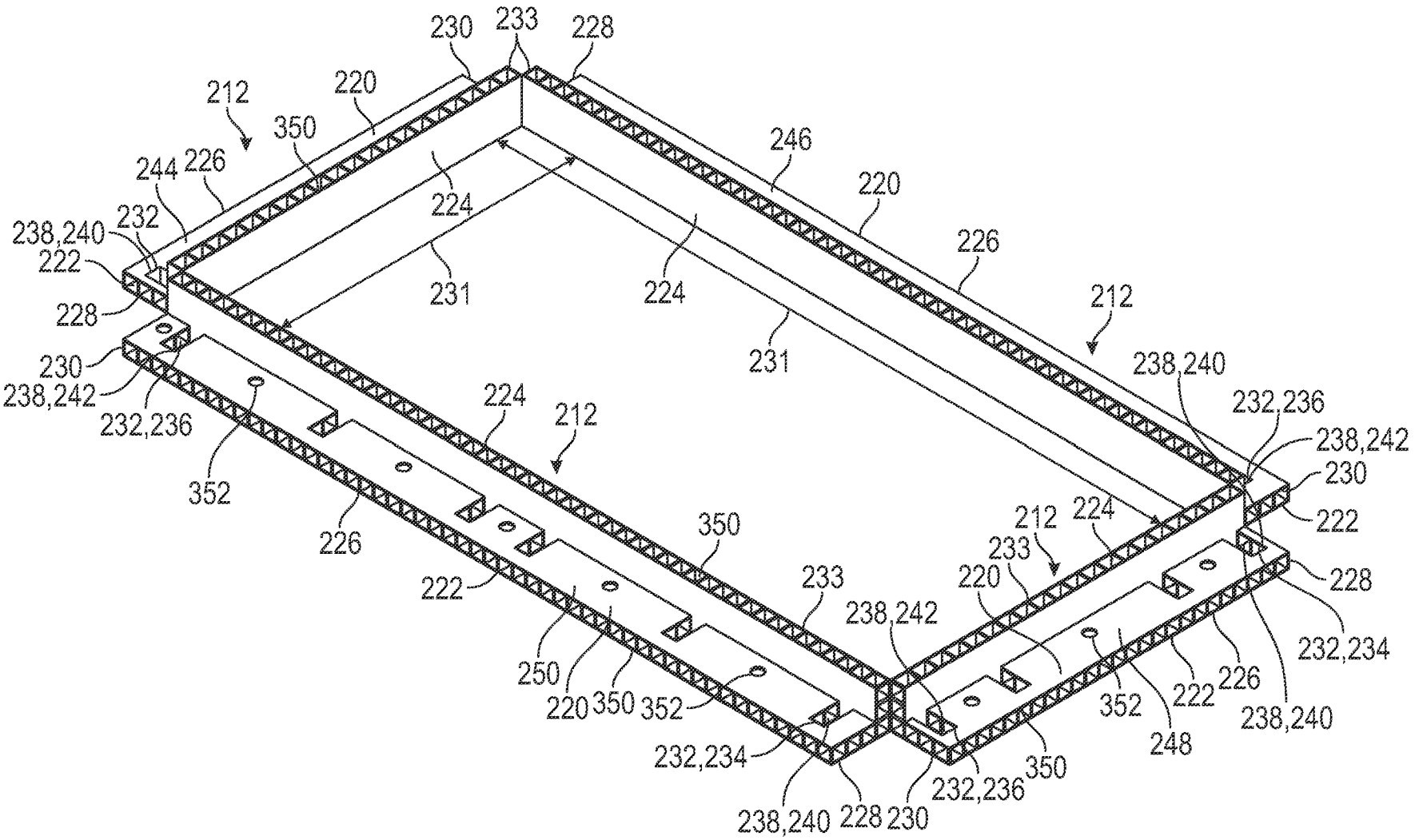
FIG. 11 is a perspective view of the first base, the second base, the third base, and the fourth base of the frame shown in FIG. 10.
Figure 12:
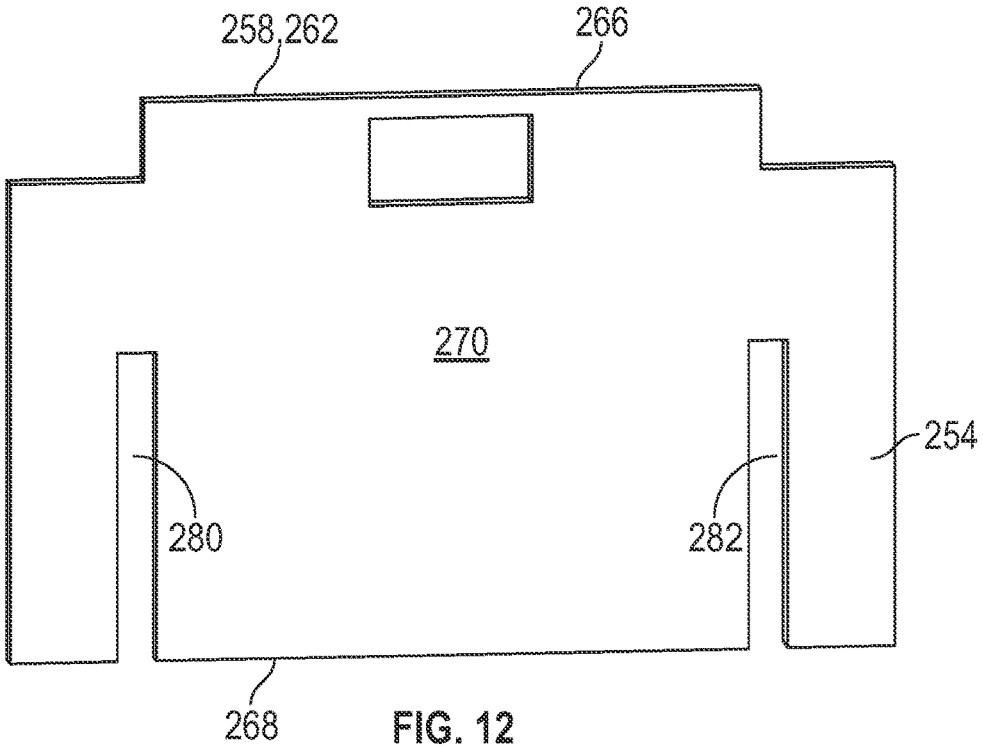
FIG. 12 is a perspective view of the first wall of the frame shown in FIG. 10.
Figure 13:
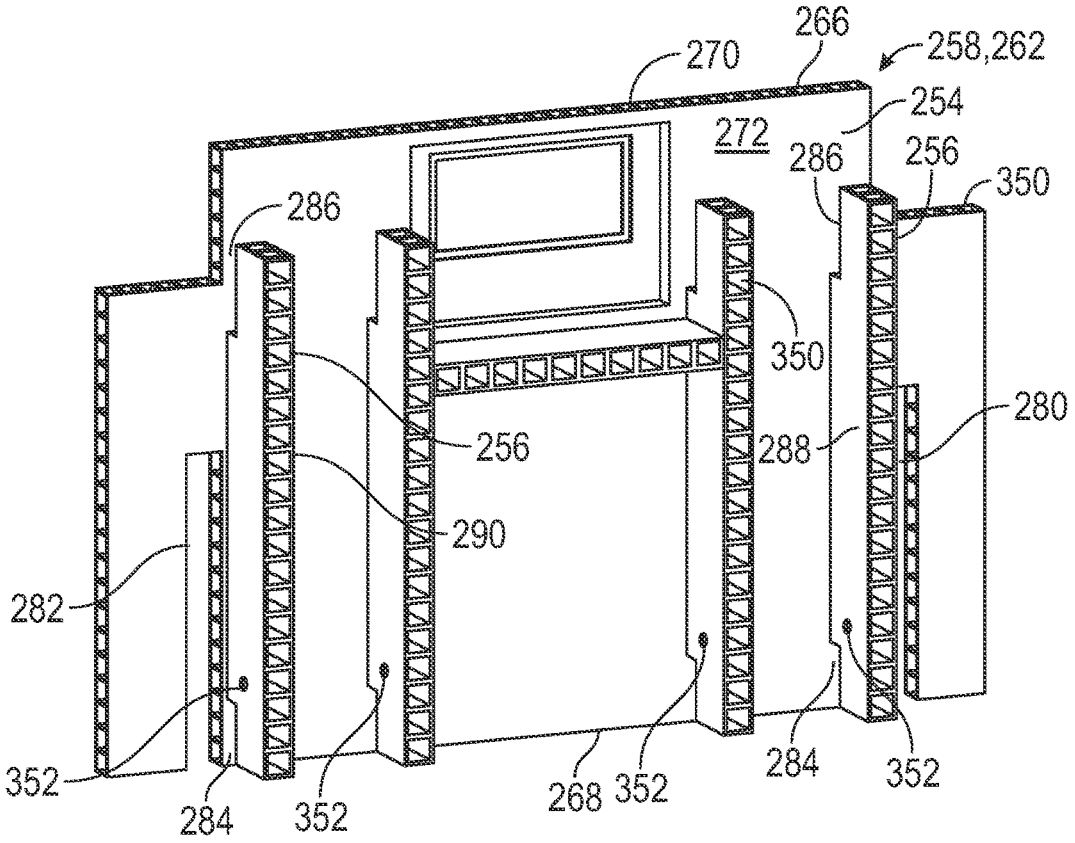
FIG. 13 is another perspective view of the first wall shown in FIG. 12.
Figure 15:
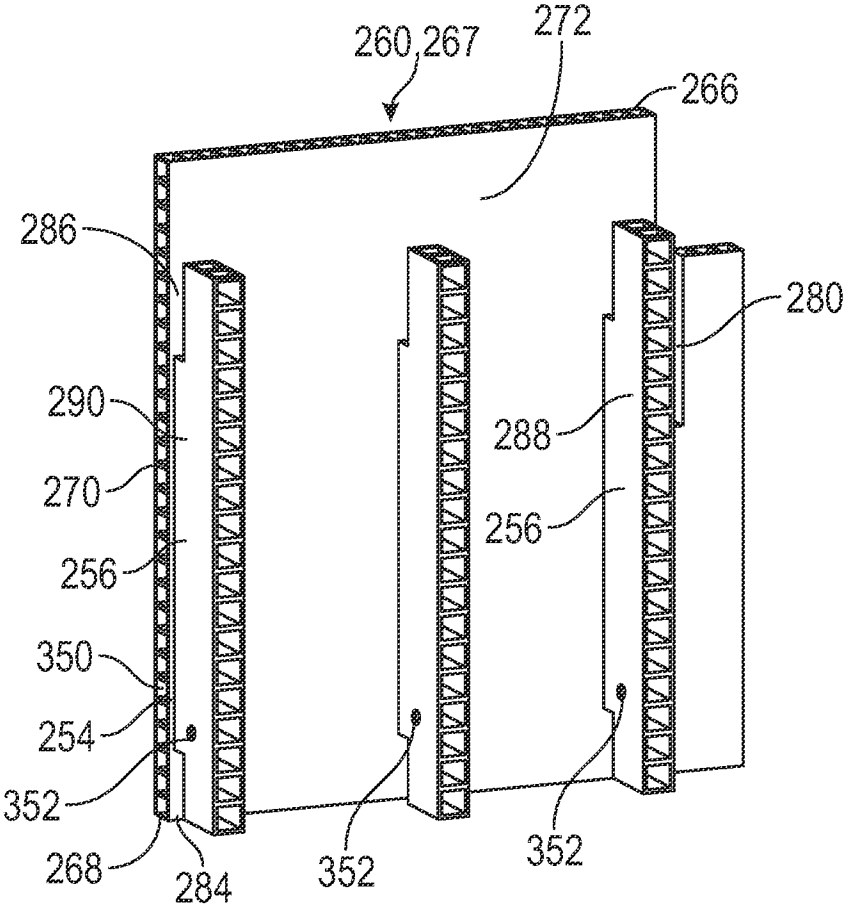
FIG. 15 is another perspective view of the second wall and the sixth wall shown in FIG. 14.
Figure 14:
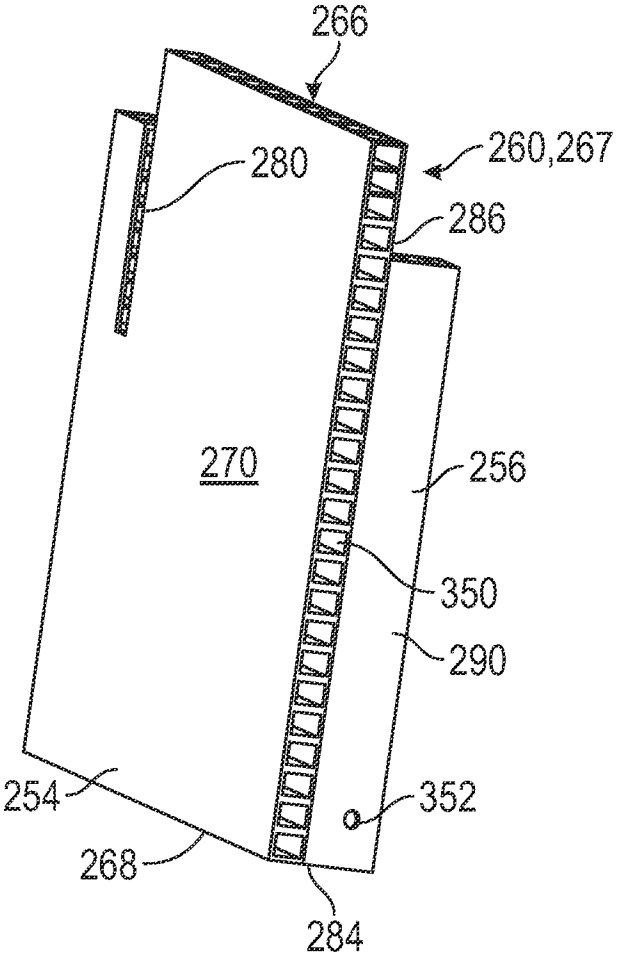
FIG. 14 is a perspective view of the second wall and the sixth wall of the frame shown in FIG. 10.
Figure 17:
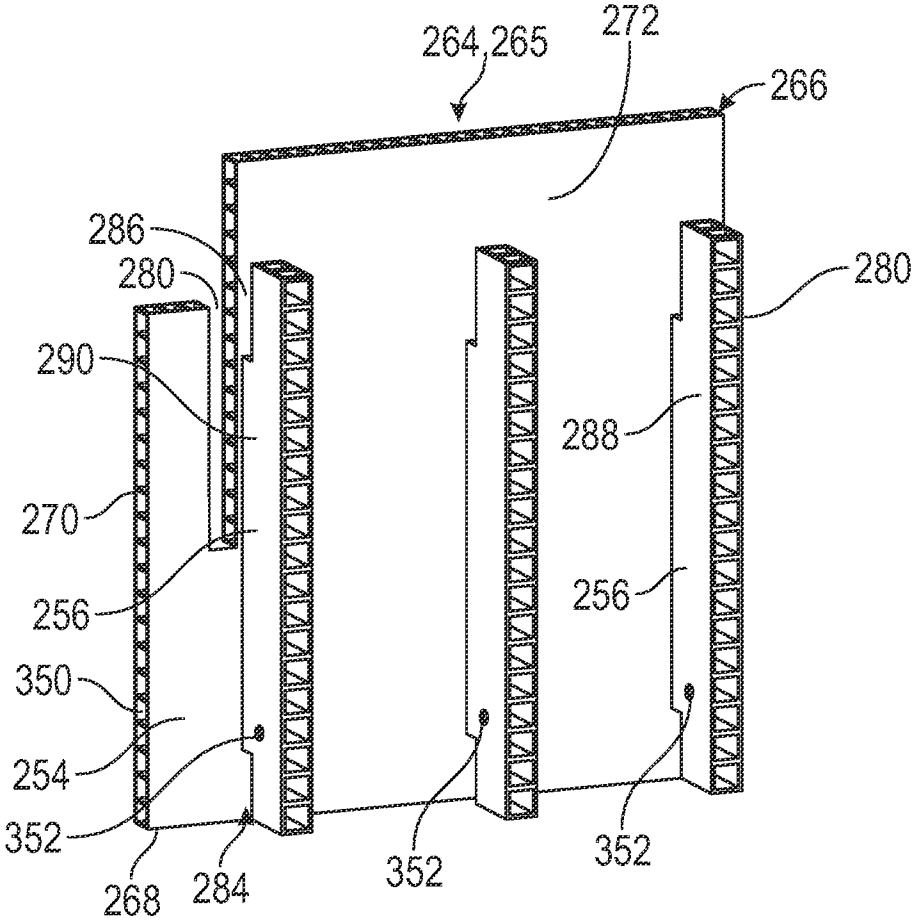
FIG. 17 is another perspective view of the fourth wall and the fifth wall shown in FIG. 16.
Figure 16:
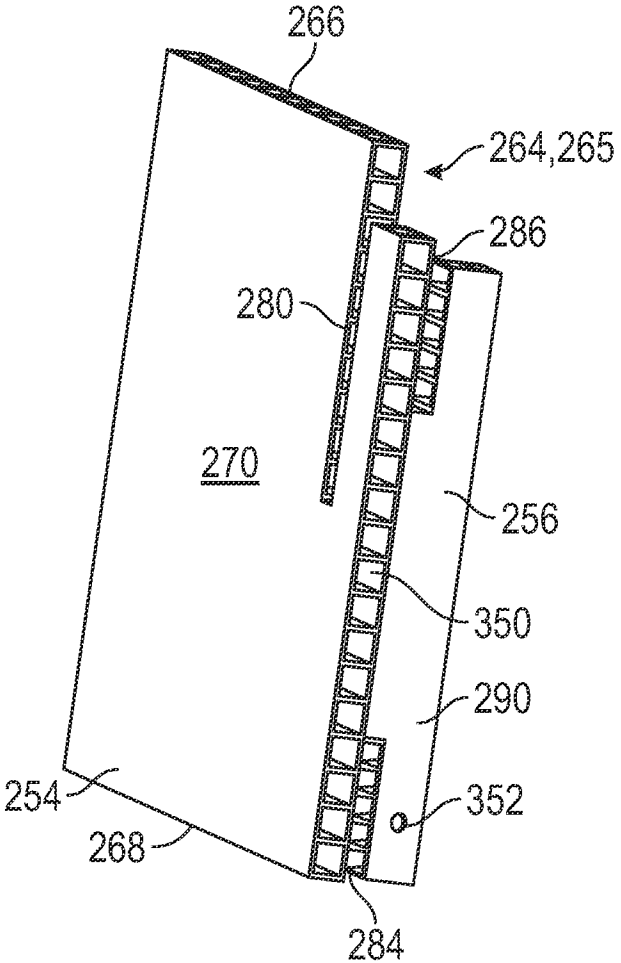
FIG. 16 is a perspective view of the fourth wall and the fifth wall of the frame shown in FIG. 10.
Figure 18:
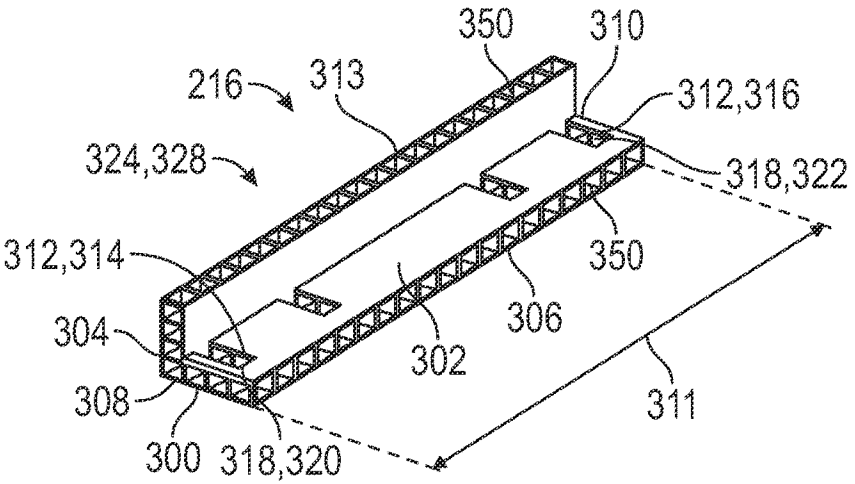
FIG. 18 is a perspective view of the first cap and the third cap of the frame shown in FIG. 10.
Figure 19:
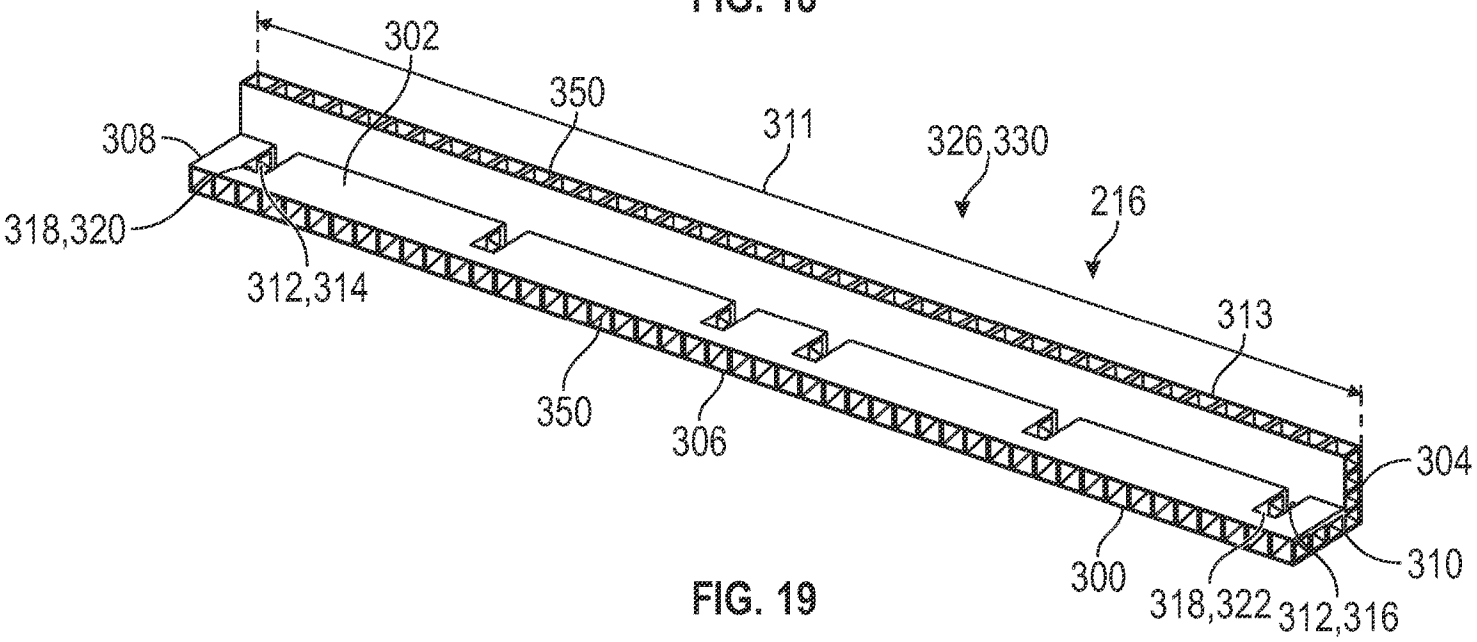
FIG. 19 is a perspective view of the second cap and the fourth cap of the frame shown in FIG. 10.

As shown in FIG. 11, each base of the plurality of bases 212 has a base top 220, a base bottom 222, a base interior end 224, a base exterior end 226, a base first terminal end 228, a base second terminal end 230, a base length 231, a plurality of base openings 232, and a base projection 233. The base projection 233 extends from the base top 220 away from the base bottom 222, from the base interior end 224 toward the base exterior end 226, and from the base first terminal end 228 to the base second terminal end 230. However, alternative embodiments can include a base projection that has a length that is greater than, or less than, a base length and/or that extends from a location between a base interior end and a base exterior end toward the base exterior end. Each of the base first opening 234 and the base second opening 236 is disposed on the base top 220 between the base projection 233 and the base exterior end 226.

In the illustrated embodiment, the plurality of bases 212 includes a first base 244, a second base 246, a third base 248, and a fourth base 250 and each base of the plurality of bases 212 has a plurality of base recesses 238. The first base 244 is identical to the third base 248 but is positioned at a different location when the frame 210 is assembled. The second base 246 is identical to the fourth base 250 but is positioned at a different location when the frame 210 is assembled. Each recess of the plurality of base recesses 238 extends from a discrete opening of the plurality of base openings 232 toward the base bottom 222. As shown in FIG. 11, the plurality of base recesses 238 includes a base first recess 240 and a base second recess 242. The base first recess 240 extends from the base first opening 234 toward the base bottom 222 and is disposed between the base interior end 224 and the base exterior end 226. The base second recess 242 extends from the base second opening 236 toward the base bottom 222 and disposed between the base interior end 224 and the base exterior end 226.

In the illustrated embodiment, the plurality of interlocking walls 214 includes a first wall 258, a second wall 260, a third wall 262, a fourth wall 264, a fifth wall 265, and a sixth wall 267. The first wall 258 is identical to the third wall 262 but includes structure for a pool filter, which can be omitted, and is positioned at a different location when the frame 210 is assembled. The second wall 260 is identical to the sixth wall 267 but is positioned at a different location when the frame 210 is assembled. The fourth wall 264 is identical to the fifth wall 265 but is positioned at a different location when the frame 210 is assembled.

Figure 10:
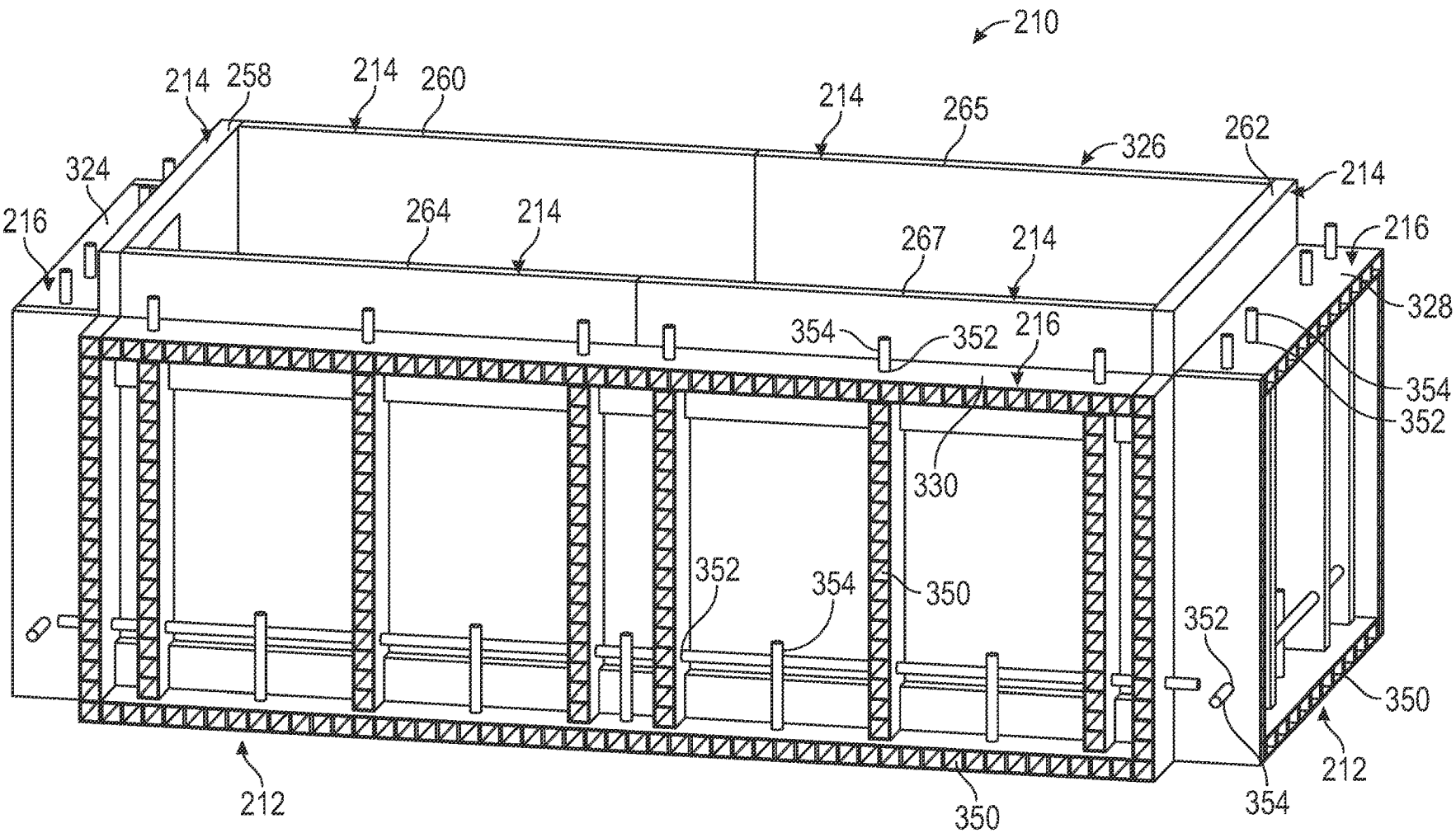
FIG. 10 is a perspective view of another example assembled frame that includes interlocking walls.

When assembled, as shown in FIG. 10, each wall of the plurality of interlocking walls 214 is interlocked with a base of the plurality of bases 212. When assembled, the first wall 258 is interlocked with the first base 244, the second wall 260 is interlocked with the second base 246, the third wall 262 is interlocked with the third base 248, the fourth wall 264 is interlocked with the fourth base 250, the fifth wall 265 is interlocked with the second base 246, and the sixth wall 267 is interlocked with the fourth base 250.

When disassembled, as shown in FIGS. 11 through 19, each wall of the plurality of interlocking walls 214 is interlockable with a base of the plurality of bases 212. When disassembled, the first wall 258 is interlockable with the first base 244, the second wall 260 is interlockable with the second base 246, the third wall 262 is interlockable with the third base 248, the fourth wall 264 is interlockable with the fourth base 250, the fifth wall 265 is interlockable with the second base 246, and the sixth wall 267 is interlockable with the fourth base 250.

In the illustrated embodiment, each of the first and third walls 258, 262 has a wall main body first notch 280 and a wall main body second notch 282 and each of the second, fourth, fifth, and sixth walls 260, 264, 265, 267 has a wall main body first notch 280. Each of the wall main body first notch 280 and the wall main body second notch 282 included on the first wall 258 and the third wall 262 extends from the wall bottom 268 toward the wall top 266 and each of the wall main body first notch 280 included on the second wall 260, the fourth wall 264, the fifth wall 265, and the sixth wall 267 extends from the wall top 266 toward the wall bottom 268.

When assembled, a portion of the second wall 260 is disposed within the wall main body second notch 282 of the first wall 258, a portion of the fourth wall 264 is disposed within the wall main body first notch 280 of the first wall 258, a portion of the fifth wall 265 is disposed within the wall main body first notch 280 of the third wall 262, and a portion of the sixth wall 267 is disposed within the wall main body second notch 282 of the third wall 262. When disassembled, a portion of the second wall 260 is disposable within the wall main body second notch 282 of the first wall 258, a portion of the fourth wall 264 is disposable within the wall main body first notch 280 of the first wall 258, a portion of the fifth wall 265 is disposable within the wall main body first notch 280 of the third wall 262, and a portion of the sixth wall 267 is disposable within the wall main body second notch 282 of the third wall 262.

Each projection of the plurality of projections 256 extends from the wall main body 254 and away from the wall interior surface 270 and, when the frame 210 is assembled, is partially disposed within a base of the plurality of bases 212 and a cap of the plurality of caps 216. When disassembled, each projection of the plurality of projections 256 is disposable within a base of the plurality of bases 212 and a cap of the plurality of caps 216. In the illustrated embodiment, each projection of the plurality of wall projections 256 extends from the wall exterior surface 272 and away from the wall interior surface 270. Each projection of the plurality of projections 256 cooperatively defines a wall bottom notch 284 and a wall top notch 286 with the wall main body 254. The plurality of wall projections 256 includes a wall first projection 288 and a wall second projection 290. The wall first projection 288 has a wall bottom notch 284 and a wall top notch 286 and the wall second projection 290 has a wall bottom notch 284 and a wall top notch 286. The wall bottom notch 284 has a depth equal to the length of a base projection 233 (e.g., the distance from a base top 220 to the top of a base projection 233) and the wall top notch 286 has a depth equal to the length of a cap projection 313 (e.g., the distance from a cap bottom 302 to the top of a cap projection 313), as described in more detail herein.

When assembled, a portion of the first wall 258 is disposed within the first base 244, a portion of the second wall 260 is disposed within the second base 246, a portion of the third wall 262 is disposed within the third base 248, a portion of the fourth wall 264 is disposed within the fourth base 250, a portion of the fifth wall 265 is disposed within the second base 246, and a portion of the sixth wall 267 is disposed within the fourth base 250. When disassembled, a portion of the first wall 258 is disposable within the first base 244, a portion of the second wall 260 is disposable within the second base 246, a portion of the third wall 262 is disposable within the third base 248, a portion of the fourth wall 264 is disposable within the fourth base 250, a portion of the fifth wall 265 is disposable within the second base 246, and a portion of the sixth wall 267 is disposable within the fourth base 250.

When assembled, the wall first projection 290 of each wall of the plurality of walls 214 is disposed within the base first opening 234 and the base first recess 240 and the wall second projection 292 of each wall of the plurality of walls 214 is disposed within the base second opening 236 and the base second recess 242. When assembled, the base projection 233 of the first base 244 is disposed within the wall bottom notch 284 of the wall first projection 288 and the wall second projection 290 of the first wall 258, the base projection 233 of the second base 246 is disposed within the wall bottom notch 284 of the wall first projection 288 and the wall second projection 290 of the second wall 260 and the fifth wall 265, the base projection 233 of the third base 248 is disposed within the wall bottom notch 284 of the wall first projection 288 and the wall second projection 290 of the third wall 260, and the base projection 233 of the fourth base 246 is disposed within the wall bottom notch 284 of the wall first projection 288 and the wall second projection 290 of the fourth wall 264 and the sixth wall 267.

When disassembled, the wall first projection 290 of each wall of the plurality of walls 214 is disposable within the base first opening 234 and the base first recess 240 and the wall second projection 292 of each wall of the plurality of walls 214 is disposable within the base second opening 236 and the base second recess 242. When disassembled, the base projection 233 of the first base 244 is disposable within the wall bottom notch 284 of the wall first projection 288 and the wall second projection 290 of the first wall 258, the base projection 233 of the second base 246 is disposable within the wall bottom notch 284 of the wall first projection 288 and the wall second projection 290 of the second wall 260 and the fifth wall 265, the base projection 233 of the third base 248 is disposable within the wall bottom notch 284 of the wall first projection 288 and the wall second projection 290 of the third wall 260, and the base projection 233 of the fourth base 246 is disposable within the wall bottom notch 284 of the wall first projection 288 and the wall second projection 290 of the fourth wall 264 and the sixth wall 267.

Each cap of the plurality of caps 216 has a cap top 300, a cap bottom 302, a cap interior end 304, a cap exterior end 306, a cap first terminal end 308, a cap second terminal end 310, a cap length 311, a plurality of cap openings 312, and a cap projection 313. The cap projection 313 extends from the cap bottom 302 away from the cap top 300, from the cap interior end 304 toward the cap exterior end 306, and from the cap first terminal end 308 to the cap second terminal end 310. However, alternative embodiments can include a cap projection that has a length that is greater than, or less than, a cap length and/or that extends from a location between a cap interior end and a cap exterior end toward the cap exterior end. Each of the cap first opening 314 and the cap second opening 316 is disposed on the cap bottom 302 between the cap projection 313 and the cap exterior end 106.

In the illustrated embodiment, the plurality of caps 216 includes a first cap 324, a second cap 326, a third cap 328, and a fourth cap 330 and each cap of the plurality of caps 216 has a plurality of cap recesses 318. The first cap 324 is identical to the third cap 328 but is positioned at a different location when the frame 210 is assembled. The second cap 326 is identical to the fourth cap 330 but is positioned at a different location when the frame 210 is assembled. Each recess of the plurality of cap recesses 318 extends from a discrete opening of the plurality of cap openings 312 toward the cap top 300. The plurality of cap recesses 318 includes a cap first recess 320 and a cap second recess 322. The cap first recess 320 extends from the cap first opening 314 toward the cap top 300 and is disposed between the cap interior end 304 and the cap exterior end 306. The cap second recess 322 extends from the cap second opening 316 toward the cap top 300 and is disposed between the cap interior end 304 and the cap exterior end 306.

When assembled, each cap of the plurality of caps 216 is interlocked with a wall of the plurality of walls 214. When assembled, the first cap 324 is interlocked with the first wall 258, the second cap 326 is interlocked with the second wall 260 and the fifth wall 265, the third cap 328 is interlocked with the third wall 262, and a fourth cap 330 is interlocked with the fourth wall 264 and the sixth wall 267. When disassembled, each cap of the plurality of caps 216 is interlockable with a wall of the plurality of walls 214. When disassembled, the first cap 324 is interlockable with the first wall 258, the second cap 326 is interlockable with the second wall 260 and the fifth wall 265, the third cap 328 is interlockable with the third wall 262, and a fourth cap 330 is interlockable with the fourth wall 264 and the sixth wall 267.

When assembled, a portion of the first wall 258 is disposed within the first cap 324, a portion of the second wall 260 is disposed within the second cap 326, a portion of the third wall 262 is disposed within the third cap 328, a portion of the fourth wall 264 is disposed within the fourth cap 330, a portion of the fifth wall 265 is disposed within the second cap 326, and a portion of the sixth wall 267 is disposed within the fourth cap 330. When assembled, a portion of each wall of the plurality of walls 214 is disposed within each of the cap first opening 314 and the cap second opening 316. When assembled, the wall first projection 290 of each wall of the plurality of walls 214 is disposed within the cap first opening 314 and the cap first recess 320 and the wall second projection 292 of each wall of the plurality of walls 214 is disposed within the cap second opening 316 and the cap second recess 322.

When disassembled, a portion of the first wall 258 is disposable within the first cap 324, a portion of the second wall 260 is disposable within the second cap 326, a portion of the third wall 262 is disposable within the third cap 328, a portion of the fourth wall 264 is disposable within the fourth cap 330, a portion of the fifth wall 265 is disposable within the second cap 326, and a portion of the sixth wall 267 is disposable within the fourth cap 330. When disassembled, a portion of each wall of the plurality of walls 214 is disposable within each of the cap first opening 314 and the cap second opening 316. When disassembled, the wall first projection 290 of each wall of the plurality of walls 214 is disposable within the cap first opening 314 and the cap first recess 320 and the wall second projection 292 of each wall of the plurality of walls 214 is disposable within the cap second opening 316 and the cap second recess 322.

When assembled, the cap projection 313 of the first cap 324 is disposed within the wall top notch 286 of the wall first projection 288 and the wall second projection 290 of the first wall 258, the cap projection 313 of the second cap 326 is disposed within the wall top notch 286 of the wall first projection 288 and the wall second projection 290 of the second wall 260 and the fifth wall 265, the cap projection 313 of the third cap 328 is disposed within the wall top notch 286 of the wall first projection 288 and the wall second projection 290 of the third wall 260, and the cap projection 313 of the fourth cap 330 is disposed within the wall top notch 286 of the wall first projection 288 and the wall second projection 290 of the fourth wall 264 and the sixth wall 267.

When disassembled, the cap projection 313 of the first cap 324 is disposable within the wall top notch 286 of the wall first projection 288 and the wall second projection 290 of the first wall 258, the cap projection 313 of the second cap 326 is disposable within the wall top notch 286 of the wall first projection 288 and the wall second projection 290 of the second wall 260 and the fifth wall 265, the cap projection 313 of the third cap 328 is disposable within the wall top notch 286 of the wall first projection 288 and the wall second projection 290 of the third wall 260, and the cap projection 313 of the fourth cap 330 is disposable within the wall top notch 286 of the wall first projection 288 and the wall second projection 290 of the fourth wall 264 and the sixth wall 267.

A component of a frame can include any suitable additional structural features, which can be selected based upon various considerations, such as the intended use of the frame. For example, as shown in FIGS. 10 through 19, a base, a wall, and/or a cap can include one or more concrete pockets 350, one or more rebar passageways 352, and/or one or more pieces of rebar 354. Inclusion of one or more of a concrete pocket 350, rebar passageways 352, and/or pieces of rebar 354 provide structure that increases the overall structural integrity of a frame after installation. For example, a concrete pocket 350 provides a void within which concrete can be positioned to increase the overall structural integrity of a frame. When included, the rebar passageways 352 included on a cap extend from a cap top to a cap recess. A concrete pocket, rebar passageway, and a piece of rebar can be included at any suitable location on a frame, or component of a frame, such as those shown and described. For example, a concrete pocket can be positioned on any suitable terminal end, or portion of, of a base, wall, or cap and have any suitable depth and shape.

Various methods of manufacturing a frame that includes interlocking walls, assembling a frame that includes interlocking walls, and shipping a frame that includes interlocking walls are described herein. While these methods are described as a series of acts, it is to be understood and appreciated that the methods are not limited by the order of acts, as some acts may in accordance with these methods occur in the order shown and/or described, in different orders, concurrently with other acts described herein, be repeated, or be omitted.

An example method 400 of manufacturing a frame (e.g., frame 10) that includes interlocking walls includes the following steps.

A step 402 includes incorporating a wall main body first notch into a first wall. Another step 404 comprises incorporating a wall main body second notch into the first wall. Another step 406 comprises incorporating a wall main body first notch into a second wall. Another step 408 comprises incorporating a wall main body second notch into the second wall. Another step 410 comprises incorporating a wall main body first notch into a third wall. Another step 412 comprises incorporating a wall main body second notch into the third wall. Another step 414 comprises incorporating a wall main body first notch into a fourth wall. Another step 416 comprises incorporating a wall main body second notch into the fourth wall. Another step 418 comprises attaching one or more projections to the first wall. Another step 420 comprises attaching one or more projections to the second wall. Another step 422 comprises attaching one or more projections to the third wall. Another step 424 comprises attaching one or more projections to the fourth wall. Another step 426 comprises incorporating one or more openings and one or more voids into a first base. Another step 428 comprises incorporating one or more openings and one or more voids into a second base. Another step 430 comprises incorporating one or more openings and one or more voids into a third base. Another step 432 comprises incorporating one or more openings and one or more voids into a fourth base. Another step 434 comprises incorporating one or more openings and one or more voids into a first cap. Another step 436 comprises incorporating one or more openings and one or more voids into a second cap. Another step 438 comprises incorporating one or more openings and one or more voids into a third cap. Another step 440 comprises incorporating one or more openings and one or more voids into a fourth cap.

Each of steps 402 through 416 can be accomplished by incorporating a wall main body notch into any suitable wall formed of any suitable material, such as those described herein, using any suitable technique or method. Examples of techniques and methods considered suitable to incorporate a wall main body notch into a wall include cutting, drilling, forming, casting, machining, 3D printing, and any other technique or method considered suitable for a particular embodiment. A wall main body notch incorporated into a wall can have any suitable structural arrangement and be positioned at any suitable location on the wall. Examples of suitable structural arrangements for a wall main body notch and of suitable locations to position a wall main body notch include those shown and described herein.

In an alternative embodiment, which relates to manufacturing frame 210, step 408 comprises incorporating a wall main body first notch into a fifth wall and step 412 comprises incorporating a wall main body first notch into a sixth wall. These steps can be accomplished as described above with respect to steps 402 through 416.

Each of steps 418 through 424 can be accomplished by attaching one or more projections to a wall using any suitable technique or method of attachment. Examples of techniques and methods of attachment considered suitable to attach a projection to a wall include welding, using an adhesive, casting, using one or more fasteners, 3D printing, and any other technique or method considered suitable for a particular embodiment. A projection attached to a wall can have any suitable structural arrangement and be positioned at any suitable location on the wall. Examples of suitable structural arrangements for a projection and of suitable locations to position a projection include those shown and described herein. Any suitable number of projections can be attached to a wall and selection of a suitable number of projections to attach to a wall include one, more than one, two, a plurality, three, four, five, six, more than six, and any other number considered suitable for a particular embodiment.

In an alternative embodiment, which relates to manufacturing frame 210, another step comprises attaching one or more projections to the fifth wall and another step comprises attaching one or more projections to the sixth wall. These steps can be accomplished as described above with respect to steps 418 through 424.

Each of steps 426 through 440 can be accomplished by incorporating one or more openings and one or more voids into any suitable base or cap formed of any suitable material, such as those described herein, using any suitable technique or method. Examples of techniques and methods considered suitable to incorporate an opening and a void into a base or cap include cutting, drilling, forming, casting, machining, 3D printing, and any other technique or method considered suitable for a particular embodiment. An opening and a void incorporated into a base or cap can have any suitable structural arrangement and be positioned at any suitable location on the base or cap. Examples of suitable structural arrangements for an opening and a void and of suitable locations to position an opening and a void include those shown and described herein.

An example method 500 of assembling a frame (e.g., frame 10) that includes interlocking walls includes the following steps.

A step 502 comprises positioning a first base, a second base, a third base, and a fourth base on a surface. Another step 504 comprises interlocking a first frame with the first base. Another step 506 comprises interlocking a third frame with the third base. Another step 508 comprises interlocking a second frame with the first frame, the third frame, and the second base. Another step 510 comprises interlocking a fourth frame with the first frame, the third frame, and the fourth base. Another step 512 comprises interlocking a first cap with the first frame. Another step 514 comprises interlocking a second cap with the second frame. Another step 516 comprises interlocking a third cap with the third frame. Another step 518 comprises interlocking a fourth cap with the fourth frame.

Another example method 550 of assembling a frame (e.g., frame 210) that includes interlocking walls includes the following steps.

A step 552 comprises positioning a first base, a second base, a third base, and a fourth base on a surface. Another step 554 comprises interlocking a second frame with the second base. Another step 556 comprises interlocking a fourth frame with the fourth base. Another step 558 comprises interlocking a first frame with the second frame, the fourth frame, and the first base. Another step 560 comprises interlocking a fifth frame with the second base. Another step 562 comprises interlocking a sixth frame with the fourth base. Another step 564 comprises interlocking a third frame with the fifth frame, the sixth frame, and the third base. Another step 566 comprises interlocking a first cap with the first frame. Another step 568 comprises interlocking a second cap with the second frame and the fifth frame. Another step 570 comprises interlocking a third cap with the third frame. Another step 572 comprises interlocking a fourth cap with the fourth frame and the sixth frame.

An example method 600 of shipping a frame (e.g., frame 10) that includes interlocking walls includes the following steps.

A step 602 comprises gathering a first base, a second base, a third base, and a fourth base. Another step 604 comprises gathering a first wall, a second wall, a third wall, and a fourth wall. Another step 606 comprises gathering a first cap, a second cap, a third cap, and a fourth cap. Another step 608 comprises transporting the first base, the second base, the third base, and the fourth base to a first location. Another step 610 comprises transporting the first wall, the second wall, the third wall, and the fourth wall to the first location. Another step 612 comprises transporting the first cap, the second cap, the third cap, and the fourth cap to the first location.

Another example method 650 of shipping a frame (e.g., frame 210) that includes interlocking walls includes the following steps.

A step 602 comprises gathering a first base, a second base, a third base, and a fourth base. Another step 604 comprises gathering a first wall, a second wall, a third wall, a fourth wall, a fifth wall, and a sixth wall. Another step 606 comprises gathering a first cap, a second cap, a third cap, and a fourth cap. Another step 608 comprises transporting the first base, the second base, the third base, and the fourth base to a first location. Another step 610 comprises transporting the first wall, the second wall, the third wall, the fourth wall, the fifth wall, and the sixth wall to the first location. Another step 612 comprises transporting the first cap, the second cap, the third cap, and the fourth cap to the first location.

The methods described herein, such as method 400, method 500, method 550, method 600, method 650, and the variations described herein, can be accomplished using any suitable frame, or component of a frame, such as those described herein.

Those with ordinary skill in the art will appreciate that various modifications and alternatives for the described and illustrated embodiments can be developed in light of the overall teachings of the disclosure, and that the various elements and features of one example described and illustrated herein can be combined with various elements and features of another example without departing from the scope of the invention. Accordingly, the particular arrangement of elements disclosed herein have been selected by the inventor(s) simply to describe and illustrate examples of the invention and are not intended to limit the scope of the invention or its protection, which is to be given the full breadth of the appended claims and any and all equivalents thereof.

What is claimed is:

1. A frame kit comprising:

a first base having a first base top, a first base bottom, a first base interior end, a first base exterior end, a first base first opening, and a first base second opening, each of the first base first opening and the first base second opening disposed on the first base top between the first base interior end and the first base exterior end;

a first wall interlockable with the first base, the first wall having a first wall main body, a first wall first projection, a first wall second projection, and an opening, the first wall main body defining a first wall main body first notch and having a first wall interior surface, each of the first wall first projection and the first wall second projection extending from the first wall main body and away from the first wall interior surface, the opening disposed between the first wall first projection and the first wall second projection; and a second wall interlockable with the first wall and having a second wall main body defining a second wall main body first notch, a portion of the first wall disposable within the second wall main body first notch;

wherein a portion of the second wall is disposable within the first wall main body first notch;

wherein the first wall first projection is disposable within the base first opening; and wherein the first wall second projection is disposable within the base second opening.

2. The kit of claim 1, wherein the first wall main body has a wall exterior surface;

wherein each of the first wall first projection and the first wall second projection extends from the first wall exterior surface and away from the first wall interior surface; and wherein the opening extends from the first wall exterior surface to the first wall interior surface.

3. The kit of claim 1, wherein the first base defines a first base first recess and a first base second recess, the first base first recess extending from the first base first opening toward the first base bottom and disposed between the first base interior end and the first base exterior end, the first base second recess extending from the first base second opening toward the first base bottom and disposed between the first base interior end and the first base exterior end.

4. The kit of claim 1, wherein the first base defines a first base first passageway and a first base second passageway, the first base first passageway extending from the first base first opening to the first base bottom and disposed between the first base interior end and the first base exterior end, the first base second passageway extending from the first base second opening to the first base bottom and disposed between the first base interior end and the first base exterior end.

5. The kit of claim 1, wherein the first base has a first base length; and wherein the first wall has a first wall length that is greater than the first base length.

6. The kit of claim 1, further comprising a first cap interlockable with the first wall, the first cap defining a first cap first opening and a first cap second opening; and wherein a portion of the first wall is disposable within each of the first cap first opening and the first cap second opening.

7. The kit of claim 6, wherein the first wall first projection cooperatively defines a first wall first top notch with the first wall main body and the first wall second projection cooperatively defines a first wall second top notch with the first wall main body.

8. The kit of claim 1, wherein the first base has one or more first base rebar passageways;

further comprising a second base having a second base top, a second base bottom, a second base interior end, a second base exterior end, a second base first opening, a second base second opening, and one or more second base rebar passageways, each of the second base first opening and the second base second opening disposed on the second base top between the second base interior end and the second base exterior end;

wherein the second wall is interlockable with the second base and includes a second wall first projection, and a second wall second projection, the second wall main body having and a second wall interior surface, each of the second wall first projection and the second wall second projection extending from the second wall main body and away from the second wall interior surface;

wherein the second wall first projection is disposable within the second base first opening; and wherein the second wall second projection is disposable within the second base second opening.

9. The kit of claim 1, wherein the first wall main body has a first wall top and a first wall bottom; and wherein the first wall main body first notch extends from the first wall top toward the first wall bottom.

10. The kit of claim 9, wherein the first wall main body has a first wall exterior surface; and wherein the first wall main body first notch extends from the first wall interior surface to the first wall exterior surface.

11. The kit of claim 1, wherein the second wall main body has a second wall top and a second wall bottom; and wherein the second wall main body first notch extends from the second wall bottom toward the second wall top.

12. The kit of claim 11, wherein the second wall main body has a second wall exterior surface; and wherein the second wall main body first notch extends from the second wall interior surface to the second wall exterior surface.

13. The kit of claim 1, wherein said frame kit is a pool frame kit; and wherein the opening is a pool filter opening.

14. The kit of claim 13, wherein said frame kit is an in-ground pool frame kit.

15. The kit of claim 1, wherein the first wall main body defines a first wall main body second notch; and wherein the opening is disposed between the first wall main body first notch and the first wall main body second notch.

16. The kit of claim 15, wherein the first wall main body has a first wall top and a first wall bottom; and wherein the first wall main body second notch extends from the first wall top toward the first wall bottom.

17. The kit of claim 1, wherein the second wall main body defines a second wall main body second notch.

18. The kit of claim 17, wherein the second wall main body has a second wall top and a second wall bottom; and wherein the second wall main body second notch extends from the second wall top toward the second wall bottom.

19. A frame kit comprising:

a first base having a first base top, a first base bottom, a first base interior end, a first base exterior end, a first base first opening, a first base second opening, and a first base length, each of the first base first opening and the first base second opening disposed on the first base top between the first base interior end and the first base exterior end;

a first wall interlockable with the first base, the first wall having a first wall main body, a first wall first projection, a first wall second projection, an opening, and a first wall length that is greater than the first base length, the first wall main body defining a first wall main body first notch and having a first wall interior surface and a first wall exterior surface, each of the first wall first projection and the first wall second projection extending from the first wall exterior surface and away from the first wall interior surface, the opening disposed between the first wall first projection and the first wall second projection and extending from the first wall exterior surface to the first wall interior surface; and a second wall interlockable with the first wall and having a second wall main body defining a second wall main body first notch, a portion of the first wall disposable within the second wall main body first notch;

wherein a portion of the second wall is disposable within the first wall main body first notch;

wherein the first wall first projection is disposable within the base first opening; and wherein the first wall second projection is disposable within the base second opening.

20. A pool frame kit comprising:

a first base having a first base top, a first base bottom, a first base interior end, a first base exterior end, a first base first opening, a first base second opening, one or more first base rebar passageways, and a first base length, each of the first base first opening and the first base second opening disposed on the first base top between the first base interior end and the first base exterior end;

a first wall interlockable with the first base, the first wall having a first wall main body, a first wall first projection, a first wall second projection, a pool filter opening, and a first wall length that is greater than the first base length, the first wall main body defining a first wall main body first notch and having a first wall interior surface, a first wall exterior surface, a first wall top, and a first wall bottom, the first wall main body first notch extending from the first wall top toward the first wall bottom, each of the first wall first projection and the first wall second projection extending from the first wall exterior surface and away from the first wall interior surface, the pool filter opening disposed between the first wall first projection and the first wall second projection and extending from the first wall exterior surface to the first wall interior surface; and a second wall interlockable with the first wall and having a second wall main body defining a second wall main body first notch, a portion of the first wall disposable within the second wall main body first notch;

a first cap interlockable with the first wall, the first cap defining a first cap first opening and a first cap second opening;

wherein a portion of the second wall is disposable within the first wall main body first notch;

wherein the first wall first projection is disposable within the base first opening;

wherein the first wall second projection is disposable within the base second opening; and wherein a portion of the first wall is disposable within each of the first cap first opening and the first cap second opening.

* * * * *